US009102897B2

(12) United States Patent
Takahashi et al.

(10) Patent No.: US 9,102,897 B2
(45) Date of Patent: Aug. 11, 2015

(54) LUBRICATING OIL COMPOSITION FOR TRANSMISSIONS

(75) Inventors: Masato Takahashi, Yokohama (JP); Shigeki Matsui, Yokohama (JP)

(73) Assignee: NIPPON OIL CORPORATION, Tokyo (JP)

( * ) Notice: Subject to any disclaimer, the term of this patent is extended or adjusted under 35 U.S.C. 154(b) by 1423 days.

(21) Appl. No.: 11/201,345

(22) Filed: Aug. 10, 2005

(65) Prior Publication Data

US 2006/0135378 A1 Jun. 22, 2006

Related U.S. Application Data

(63) Continuation of application No. PCT/JP2004/000906, filed on Jan. 30, 2004.

(30) Foreign Application Priority Data

Feb. 21, 2003 (JP) ..... 2003-045072
Feb. 21, 2003 (JP) ..... 2003-045073

(51) Int. Cl.
*C10M 169/04* (2006.01)
*C10M 101/02* (2006.01)

(52) U.S. Cl.
CPC ..... *C10M 169/04* (2013.01); *C10M 101/02* (2013.01); *C10M 101/025* (2013.01); *C10M 2203/1006* (2013.01); *C10M 2203/106* (2013.01); *C10M 2203/1025* (2013.01); *C10M 2203/1065* (2013.01); *C10M 2207/026* (2013.01); *C10M 2209/084* (2013.01); *C10M 2209/086* (2013.01); *C10M 2215/04* (2013.01); *C10M 2215/28* (2013.01); *C10M 2219/066* (2013.01); *C10M 2219/08* (2013.01); *C10M 2219/106* (2013.01); *C10M 2223/02* (2013.01); *C10M 2223/04* (2013.01); *C10N 2230/02* (2013.01); *C10N 2230/10* (2013.01); *C10N 2240/02* (2013.01); *C10N 2240/04* (2013.01)

(58) Field of Classification Search
USPC ..... 508/433, 438, 564, 567
See application file for complete search history.

(56) References Cited

U.S. PATENT DOCUMENTS

| | | | | |
|---|---|---|---|---|
| 4,609,480 | A | 9/1986 | Hata et al. | |
| 5,019,662 | A * | 5/1991 | Vora et al. | 585/323 |
| 5,105,051 | A * | 4/1992 | Pelrine et al. | 585/528 |
| 5,225,093 | A * | 7/1993 | Campbell et al. | 508/287 |
| 5,523,005 | A * | 6/1996 | Di Biase et al. | 508/323 |
| 5,573,696 | A * | 11/1996 | Hughes et al. | 508/224 |
| 5,691,283 | A * | 11/1997 | Poat et al. | 508/186 |
| 6,110,879 | A * | 8/2000 | Kramer et al. | 508/469 |
| 6,251,840 | B1 * | 6/2001 | Ward et al. | 508/162 |
| 6,451,745 | B1 * | 9/2002 | Ward | 508/192 |
| 6,503,872 | B1 * | 1/2003 | Tomaro | 508/377 |
| 7,670,996 | B2 * | 3/2010 | Daniel et al. | 508/110 |
| 2003/0000866 | A1 * | 1/2003 | Cain | 208/18 |
| 2003/0008783 | A1 * | 1/2003 | Ostyn et al. | 508/272 |
| 2003/0186824 | A1 * | 10/2003 | Chiu et al. | 508/490 |
| 2004/0038833 | A1 * | 2/2004 | Deckman et al. | 508/192 |

FOREIGN PATENT DOCUMENTS

| | | | |
|---|---|---|---|
| EP | 0 240 813 | A2 | 10/1987 |
| EP | 0 286 996 | A2 | 10/1988 |
| EP | 1 002 855 | A2 | 5/2000 |
| GB | 2 360 528 | A | 9/2001 |
| JP | 03-039399 | A | 2/1991 |
| JP | 07-268375 | A | 10/1995 |
| JP | 09-132790 | A | 5/1997 |
| JP | 09-208976 | A | 8/1997 |
| JP | 10-316987 | A | 12/1998 |
| JP | 10-330778 | A | 12/1998 |
| JP | 11-189782 | A | 7/1999 |
| JP | 11-323371 | A | 11/1999 |
| JP | 11323371 | A * | 11/1999 |
| JP | 2000-063869 | A | 2/2000 |
| WO | WO 9718282 | A1 * | 5/1997 |
| WO | WO 02064711 | A1 * | 8/2002 |

* cited by examiner

*Primary Examiner* — Taiwo Oladapo
(74) *Attorney, Agent, or Firm* — Panitch Schwarze Belisario & Nadel LLP

(57) ABSTRACT

A lubricating oil composition for transmissions comprises a lubricating base oil comprising (A) a lubricating base oil so adjusted to have a kinematic viscosity at 100° C. of from 1.5 to 5 $mm^2/s$ and a % $C_N$ of from 10 to 60 (B) a mineral lubricating base oil having a kinematic viscosity at 100° C. of from 10 to 50 $mm^2/s$ and a sulfur content of from 0.3 to 1 percent by mass and (C) a synthetic oil composed of carbon and hydrogen and having a number average molecular weight of from 2,000 to 20,000, in respective specific amounts and (D) an extreme pressure additive of from 0.05 to 2 percent by mass, based on the total amount of the composition, of comprising a phosphorus-based extreme pressure additive, a sulfur-based extreme pressure additive and/or a phosphorus-sulfur-based extreme pressure additive, wherein in the composition, the phosphorus content (P) is from 0.01 to 0.05 percent by mass, the total sulfur content (S) is from 0.05 to 0.3 percent by mass, and the P/S ratio is from 0.10 to 0.40. The lubricating oil composition has both excellent fuel economy performance and satisfactory durability for gears and bearings and furthermore excellent low temperature viscosity and oxidation stability.

19 Claims, No Drawings

LUBRICATING OIL COMPOSITION FOR TRANSMISSIONS

CROSS-REFERENCE TO RELATED APPLICATION

This application is a continuation of International Application No. PCT/JP2004/000906, filed Jan. 30, 2004, which was published in the Japanese language on Sep. 2, 2004, under International Publication No. WO 2004/074414 A1, the disclosure of which is incorporated herein by reference.

FIELD OF THE INVENTION

This invention relates to lubricating oil compositions for transmissions and more specifically to those suitable for automatic transmissions, manual transmissions and continuously variable transmissions of automobiles, which compositions are excellent in properties of extending the fatigue life thereof (hereinafter referred to merely as "fatigue life properties") though low in viscosity and excellent in low temperature viscosity and oxidation stability. The present invention also relates to a method for improving the fatigue life properties of a low-viscosity lubricating oil for transmissions.

BACKGROUND OF THE INVENTION

In recent years, from the viewpoint of approaching to environmental issues such as reduction of carbon dioxide emission, there arises an urgent need that automobiles, construction machines and agricultural machines consume less energy, i.e., are reduced in fuel-consumption thereof. Particularly, there is a growing demand that their devices such as engines, transmissions, final reduction gear units, compressors and hydraulic equipment contribute energy saving. Therefore, the lubricating oils used in these devices are demanded to be less in stirring resistance and frictional resistance than ever before.

Lowering the viscosity of a lubricating oil may be an example as a means of improving the fuel economy performance of a transmission and final reduction gear unit contributive to improve fuel economy performance. For example, an automobile automatic transmission or continuously variable transmission has a torque converter, a wet clutch, a gear bearing mechanism, an oil pump and a hydraulic control system, while a manual transmission or final reduction gear unit has a gear bearing mechanism. Lowering the viscosity of a lubricating oil to be used in such transmissions can reduce the stirring and frictional resistances of the torque converter, wet clutch, gear bearing mechanism and oil pump and thus enhance the power transmission efficiency thereof, resulting in an improvement in the fuel economy performance of the automobile.

However, lowering the viscosity of the lubricating oil used in these transmissions causes the above-described devices and mechanisms thereof to be significantly shortened in fatigue life and may generate seizure resulting in some defects in the transmissions. Particularly when a low viscosity lubricating oil is blended with a phosphorus-based extreme pressure additive for enhancing the extreme pressure properties, the fatigue life properties extremely deteriorate. Therefore, it is generally difficult to lower the viscosity of a lubricating oil. Although sulfur-based extreme pressure additives can improve the fatigue life properties of a lubricating oil, it is generally known that the viscosity of the base oil gives a more effect on the fatigue life properties than additives under low lubricating conditions.

Examples of automobile transmission oils which can render a transmission capable of maintaining various properties such as shifting properties for a long time include those obtained by optimizing and blending synthetic and/or mineral base oils, antiwear agents, extreme pressure additives, metallic detergents, ashless dispersants, friction modifiers and viscosity index improvers as disclosed in Japanese Patent Laid-Open Publication Nos. 3-39399, 7-268375 and 2000-63869. However, any of these compositions was not aimed at improving fuel economy performance and thus high in kinematic viscosity. Any of the publications does not refer to effects on the fatigue life properties obtained by lowering the viscosity of the lubricating oils at all. Therefore, a composition which can solve the foregoing problems has not been sufficiently studied yet. Furthermore, the transmission lubricating oils are required to have excellent low temperature viscosity and oxidation stability.

DISCLOSURE OF THE INVENTION

The present invention was made in view of the foregoing situations and intends to provide a lubricating oil for transmissions which is low in viscosity but capable of providing a long fatigue life and excellent in low temperature viscosity and oxidation stability, particularly such a lubricating oil composition suitable for the automatic transmission, manual transmission and continuously variable transmission of an automobile, with fuel economy properties and long-lasting low friction properties for the gears and bearings.

As a result of an extensive study and research conducted for solving the above-described problems, the present invention was achieved based on the finding that the above problems were able to be solved with a lubricating oil composition for transmissions which was obtained by blending a lubricating base oil comprising a low viscosity lubricating base oil so adjusted to have specific % $C_A$ and % $C_N$, a high viscosity mineral lubricating base oil with a specific sulfur content and a synthetic oil composed of carbon and hydrogen and having a specific number-average molecular weight with a specific extreme pressure additive such that the ratio of the content of phosphorus and the total sulfur content in the composition was adjusted to be within a specific range.

According to a first aspect of the present invention, there is provided with a lubricating oil composition for transmissions which comprises a lubricating base oil comprising (A) from 60 to 95 percent by mass, based on the total amount of the base oil, of a lubricating base oil so adjusted to have a kinematic viscosity at 100° C. of from 1.5 to 5 $mm^2/s$ and a % $C_N$ of from 10 to 60 and (B) from 5 to 40 percent by mass, based on the total amount of the base oil, of a mineral lubricating base oil having a kinematic viscosity at 100° C. of from 10 to 50 $mm^2/s$ and a sulfur content of from 0.3 to 1 percent by mass, and (D) from 0.05 to 2 percent by mass, based on the total amount of the composition, of an extreme pressure additive comprising a phosphorus-based extreme pressure additive, a sulfur-based extreme pressure additive and/or a phosphorus-sulfur-based extreme pressure additive, wherein in the composition, the phosphorus content (P) is from 0.01 to 0.05 percent by mass, the total sulfur content (S) is from 0.05 to 0.3 percent by mass, and the P/S ratio is from 0.10 to 0.40.

According to a second aspect of the present invention, there is provided with a lubricating oil composition for transmissions which comprises a lubricating base oil comprising (A) from 60 to 94 percent by mass, based on the total amount of the base oil, of a lubricating base oil so adjusted to have a kinematic viscosity at 100° C. of from 1.5 to 5 $mm^2/s$, a % CN of from 10 to 60 and a % CA of 1 or less, (B) from 5 to 25 percent by mass, based on the total amount of the base oil, of a mineral lubricating base oil having a kinematic viscosity at 100° C. of from 10 to 50 $mm^2/s$ and a sulfur content of from 0.3 to 1 percent by mass and (C) from 1 to 15 percent by mass., based on the total amount of the base oil, of a synthetic oil composed of carbon and hydrogen and having a number average molecular weight of from 2,000 to 20,000, and (D) from 0.05 to 2 percent by mass, based on the total amount of the composition, of an extreme pressure additive comprising a phosphorus-based extreme pressure additive, a sulfur-based extreme pressure additive and/or a phosphorus-sulfur-based extreme pressure additive, wherein in the composition, the phosphorus content (P) is from 0.01 to 0.05 percent by mass, the total sulfur content (S) is from 0.05 to 0.3 percent by mass, and the P/S ratio is from 0.10 to 0.40.

According to a third aspect of the present invention, there is provided with a method of improving the fatigue life properties of a lubricating oil composition for transmissions which comprises a lubricating base oil comprising (A) from 60 to 95 percent by mass, based on the total amount of the base oil, of a lubricating base oil so adjusted to have a kinematic viscosity at 100° C. of from 1.5 to 5 $mm^2/s$ and a % $C_N$ of from 10 to 60 and (B) from 5 to 40 percent by mass, based on the total amount of the base oil, of a mineral lubricating base oil having a kinematic viscosity at 100° C. of from 10 to 50 $mm^2/s$ and a sulfur content of from 0.3 to 1 percent by mass, and (D) from 0.05 to 2 percent by mass, based on the total amount of the composition, of an extreme pressure additive comprising a phosphorus-based extreme pressure additive, a sulfur-based extreme pressure additive and/or a phosphorus-sulfur-based extreme pressure additive, wherein in the composition, the phosphorus content (P) is from 0.01 to 0.05 percent by mass, the total sulfur content (S) is from 0.05 to 0.3 percent by mass, and the P/S ratio is from 0.10 to 0.40.

According to a forth aspect of the present invention, there is provided with a method of improving the fatigue life properties of a lubricating oil composition for transmissions which comprises a lubricating base oil comprising (A) from 60 to 94 percent by mass, based on the total amount of the base oil, of a lubricating base oil so adjusted to have a kinematic viscosity at 100° C. of from 1.5 to 5 $mm^2/s$, a % CN of from 10 to 60 and a % CA of 1 or less, (B) from 5 to 25 percent by mass, based on the total amount of the base oil, of a mineral lubricating base oil having a kinematic viscosity at 100° C. of from 10 to 50 $mm^2/s$ and a sulfur content of from 0.3 to 1 percent by mass and (C) from 1 to 15 percent by mass, based on the total amount of the base oil, of a synthetic oil composed of carbon and hydrogen and having a number-average molecular weight of from 2,000 to 20,000, and (D) from 0.05 to 2 percent by mass, based on the total amount of the composition, of an extreme pressure additive comprising a phosphorus-based extreme pressure additive, a sulfur-based extreme pressure additive and/or a phosphorus-sulfur-based extreme pressure additive, wherein in the composition, the phosphorus content (P) is from 0.01 to 0.05 percent by mass, the total sulfur content (S) is from 0.05 to 0.3 percent by mass, and the P/S ratio is from 0.10 to 0.40.

The present invention will be described in more details below.

The lubricating base oil (A) (hereinafter referred to as "Component (A)") used in the first aspect of the present invention is a lubricating base oil so adjusted to have a kinematic viscosity at 100° C. of from 1.5 to 5 $mm^2/s$ and a % CN of from 10 to 60 and may be a mineral lubricating base oil, synthetic lubricating base oil or a mixture thereof.

Component (A) used in the second aspect of the present invention is a lubricating base oil so adjusted to have a kinematic viscosity at 100° C. of from 1.5 to 5 $mm^2/s$, a % $C_N$ of from 10 to 60 and a % $C_A$ of 1 or less and may be a mineral lubricating base oil, synthetic lubricating base oil or a mixture thereof.

Examples of mineral lubricating base oils include paraffinic or naphthenic oils which can be obtained by subjecting a lubricating oil fraction produced by atmospheric- or vacuum-distillation of a crude oil, to any suitable combination of refining processes selected from solvent deasphalting, solvent extraction, hydrocracking, solvent dewaxing, catalytic dewaxing, hydrorefining, washing with sulfuric acid, and clay treatment; n-paraffines; and iso-paraffines.

No particular limitation is imposed on the method of producing the mineral lubricating base oil. For example, there may be used paraffinic or naphthenic oils which can be obtained by subjecting a lubricating oil fraction produced by atmospheric- or vacuum-distillation of a crude oil, to any one or more refining processes selected from solvent deasphalting, solvent extraction, hydrocracking, solvent dewaxing, catalytic dewaxing, hydrorefining, washing with sulfuric acid, and clay treatment. These base oils may be used alone or combined at an arbitrary percentage.

Examples of preferred mineral lubricating base oils include the following base oils:

(1) a distillate oil produced by atmospheric distillation of a paraffin base crude oil and/or a mixed base crude oil;
(2) a whole vacuum gas oil (WVGO) produced by vacuum distillation of the topped crude of a paraffin base crude oil and/or a mixed base crude oil;
(3) a wax obtained by a lubricating oil dewaxing process and/or a Fischer Tropsch wax produced by a GTL process;
(4) an oil obtained by mild-hydrocracking (MHC) one or more oils selected from oils of (1) to (3) above;
(5) a mixed oil of two or more oils selected from (1) to (4) above;
(6) a deasphaltated oil (DAO) obtained by deasphalting an oil of (1), (2) (3), (4) or (5);
(7) an oil obtained by mild-hydrocracking (MHC) an oil of (6); and
(8) a lubricating oil obtained by subjecting a mixed oil of two or more oils selected from (1) to (7) used as a feed stock and/or a lubricating oil fraction recovered therefrom to a normal refining process and further recovering a lubricating oil fraction from the refined product.

No particular limitation is imposed on the normal refining process. Therefore, there may be used any refining process conventionally used upon production of a lubricating base oil. Examples of the normal refining process include (a) hydrorefining processes such as hydrocracking and hydrofinishing, (b) solvent refining such as furfural extraction, (c) dewaxing such as solvent dewaxing and catalytic dewaxing, (d) clay refining with acid clay or active clay and (e) chemical (acid or alkali) refining such as sulfuric acid treatment and sodium hydroxide treatment. In the present invention, any one or more of these refining processes may be used in any order.

The mineral lubricating base oil used in the present invention is particularly preferably a base oil obtained by subjecting a base oil selected from (1) to (8) described above to the following treatments.

That is, preferred are a hydrocracked mineral oil and/or wax-isomerized isoparaffin base oil obtained by hydrocracking or wax-isomerizing a base oil selected from (1) to (8) described above as it is or a lubricating fraction recovered therefrom and subjecting the resulting product as it is or a lubricating fraction recovered therefrom to dewaxing such as solvent dewaxing or catalytic dewaxing, followed by solvent refining or followed by solvent refining and then dewaxing such as solvent dewaxing or catalytic dewaxing. The hydrocracked mineral oil and/or wax-isomerized isoparaffin base oil are used in an amount of preferably 30 percent by mass or more, more preferably 50 percent by mass or more, particularly preferably 70 percent by mass or more, based on the total amount of the base oil.

Examples of synthetic lubricating base oils include poly-α-olefins and hydrides thereof; isobutene oligomers and hydrides thereof; isoparaffins; alkylbenzenes; alkylnaphthalenes; diesters such as ditridecyl glutarate, di-2-ethylhexyl adipate, diisodecyl adipate, ditridecyl adipate and di-2-ethylhexyl cebacate; polyol esters such as trimethylolpropane caprylate, trimethylolpropane pelargonate, pentaerythritol 2-ethylhexanoate and pentaerythritol pelargonate; polyoxyalkylene glycols; dialkyldiphenyl ethers; and polyphenyl ethers.

Preferred synthetic lubricating base oils are poly-α-olefins. Typical examples of poly-α-olefins include oligomers or cooligomers of α-olefins having 2 to 32, preferably 6 to 16 carbon atoms, such as 1-octene oligomer, 1-decene oligomer, ethylene-propylene cooligomer, and hydrides thereof.

No particular limitation is imposed on the method of producing poly-α-olefins. For example, poly-α-olefins may be produced by polymerizing α-olefins in the presence of a polymerization catalyst such as a Friedel-Crafts catalyst containing aluminum trichloride, boron trifluoride or a complex of boron trifluoride with water, an alcohol such as ethanol, propanol and butanol, a carboxylic acid or an ester such as ethyl acetate and ethyl propionate.

The upper limit of the kinematic viscosity at 100° C. of Component (A) is 5 $mm^2/s$, preferably 4.5 $mm^2/s$, more preferably 4.0 $mm^2/s$, particularly preferably 3.8 $mm^2/s$, while the lower limit is 1.5 $mm^2/s$, preferably 2.0 $mm^2/s$, more preferably 2.5 $mm^2/s$. A lubricating base oil with a kinematic viscosity at 100° C. of 5 $mm^2/s$ or less is small in fluid resistance and thus the use of such a lubricating base oil renders it possible to produce a lubricating oil composition with a small friction resistance at lubricating sites. The use of a lubricating base oil with a kinematic viscosity at 100° C. of 1.5 $mm^2/s$ or greater renders it possible to produce a lubricating oil composition which is sufficient in oil film formation leading to excellent lubricity and less in evaporation loss of the base oil under elevated temperature conditions.

The % $C_N$ of Component (A) is from 10 to 60, preferably 17 or greater, more preferably 20 or greater and particularly preferably 22 or greater, and preferably 40 or less, more preferably 30 or less. Component (A) with a % $C_N$ of 10 or greater can enhance the effects of Component (B) and an extreme pressure additive thereby producing a composition with excellent fatigue life properties, while Component (A) with a % $C_N$ or 60 or less is contributive to production of a composition which is less preventive in the motion of the machines even at low temperatures.

No particular limitation is imposed on the % $C_A$ of Component (A) in the first aspect of the present invention. However, the % $C_A$ is preferably 2 or less, more preferably 1 or less, particularly preferably 0.5 or less. Component (A) with a % $C_A$ of 2 or less is contributive to production of a composition with a more excellent oxidation stability.

The % $C_A$ of Component (A) in the second aspect of the present invention is 1 or less, preferably 0.5 or less. Component (A) with a % $C_A$ of 1 or less is contributive to production of a composition with a more excellent oxidation stability.

The terms "% $C_N$" and "% $C_A$" each denote a percentage of naphthene carbon number to total carbon number and a percentage of aromatic carbon number to total carbon number, determined by a method prescribed in ASTM D 3238-85.

No particular limitation is imposed on the viscosity index of Component (A). However, the viscosity index is preferably 80 or greater, more preferably 90 or greater, particularly preferably 110 or greater. The use of a lubricating base oil with a viscosity index of 80 or greater renders it possible to produce a composition with excellent viscosity characteristics from low temperatures to high temperatures.

No particular limitation is imposed on the sulfur content of Component (A). However, the sulfur content is preferably 0.05 percent by mass or less, more preferably 0.02 percent by mass or less, particularly preferably 0.005 percent by mass or less. Reduction of the sulfur content of Component (A) renders it possible to obtain a composition with an excellent oxidation stability.

Component (A) may be a mixture of two or more types of mineral base oils or two or more types of synthetic base oils or a mixture of mineral base oils and synthetic base oils as long as Component (A) fulfills the above-described requirements. The mix ratio of two or more base oils in such mixtures may be arbitrarily selected.

The content of Component (A) in the lubricating oil composition for transmissions according to the first aspect of the present invention is from 60 to 95 percent by mass, preferably 70 percent by mass or more, more preferably 75 percent by mass or more, based on the total amount of the base oil.

The content of Component (A) in the lubricating oil composition for transmissions according to the second aspect of the present invention is from 60 to 94 percent by mass, preferably 70 percent by mass or more, more preferably 75 percent by mass or more, based on the total amount of the base oil.

The mineral lubricating base oil (B) (hereinafter referred to as "Component (B)") of the lubricating oil composition of the present invention is a mineral lubricating base oil having a kinematic viscosity at 100° C. of from 10 to 50 $mm^2/s$ and a sulfur content of from 0.3 to 1 percent by mass.

The kinematic viscosity at 100° C. of Component (B) is from 10 to 50 $mm^2/s$, preferably 10 to 35 $mm^2/s$. The kinematic viscosity at 100° C. of Component (B) in the first aspect of the present invention is more preferably from 10 to 25 $mm^2/s$, particularly preferably 10 to 16 $mm^2/s$ while the kinematic viscosity at 100° C. of Component (B) in the second aspect of the present invention is more preferably from 16 to 35 $mm^2/s$ and particularly preferably 18 to 25 $mm^2/s$. A mineral base oil with a kinematic viscosity at 100° C. of less than 10 $mm^2/s$ is not effective in the enhancement of fatigue life properties, while that with a kinematic viscosity at 100° C. of greater than 50 $mm^2/s$ renders it difficult to produce a lubricating oil with the desired low viscosity.

The sulfur content of Component (B) is from 0.3 to 1 percent by mass, preferably 0.4 to 1 percent by mass, more preferably 0.5 to 1 percent by mass. Since it is considered that the sulfur-containing compound in Component (B) is contributive to an improvement in fatigue life properties, a mineral base oil with a sulfur content of less than 0.3 percent by mass is not preferable because it is less contributive to such improvement. A mineral base oil with a sulfur content of more than 1 percent by mass adversely affects the oxidation stability of the resulting composition.

The % CN of Component (B) is preferably from 15 to 40, more preferably 20 to 30 with the objective of excellent fatigue life properties.

The content of Component (B) in the lubricating oil composition for transmissions according to the first aspect of the present invention is from 5 to 40 percent by mass, preferably 5 to 25 percent by mass, particularly preferably 10 to 25 percent by mass, based on the total amount of the base oil.

The content of Component (B) in the lubricating oil composition for transmissions according to the second aspect of the present invention is from 5 to 25 percent by mass, preferably 5 to 20 percent by mass, particularly preferably 5 to 15 percent by mass, based on the total amount of the base oil.

Component (C) of the lubricating oil composition for transmissions according to the second aspect of the present invention is a synthetic oil composed of carbon and hydrogen, which synthetic oil necessarily has a number-average molecular weight of from 2,000 to 20,000.

Examples of Component (C) include polymers and copolymers of α-olefins having 2 to 32 carbon atoms, preferably 2 to 16 carbon atoms, and hydrides thereof. Specific examples include isobutene oligomer, 1-octene oligomer, 1-decene oligomer, hydrides thereof, copolymers of ethylene such as ethylene-propylene oligomer with α-olefins having 3 to 32 carbon atoms and hydrides of these copolymers.

The number-average molecular weight of Component (C) is preferably 3,000 or greater, more preferably 10,000 or greater, particularly preferably 15,000 or greater, and preferably 18,500 or less. Component (C) with a number-average molecular weight of less than 2,000 is less effective in an improvement in fatigue life properties, while Component (C) with a number-average molecular weight of greater than 20,000 adversely affects low temperature viscosity characteristics even though it is blended in a small amount.

Since Component (C) is variable in characteristics depending on its type, it is desired to select an optimum synthetic oil as Component (C) in order to improve fatigue life properties. For example, in the case of using a polymer or copolymer of an α-olefin having 8 to 16 carbon atoms or any hydride thereof, it is preferable to select such a polymer or copolymer having a kinematic viscosity at 100° C. of 40 to 500 $mm^2/s$, preferably 80 to 350 $mm^2/s$. A composition having more excellent effects on improvements in fatigue life properties and shear stability can be obtained using such a polymer and copolymer of an α-olefin having 8 to 16 carbon atoms and a hydride thereof thereby rendering it easier to maintain initial extreme pressure properties for a long period of time. In the case of using any copolymer of ethylene with an α-olefin having 3 to 32 carbon atoms or a hydride thereof, it is preferable to select that having a kinematic viscosity at 100° C. of greater than 500 $mm^2/s$. Since such a copolymer or hydride thereof with a higher molecular weight can exhibit a more excellent fatigue life improvement effect even though it is blended in a small amount and thus is contributive to production of a composition which is excellent particularly in shear stability, the copolymer or hydride thereof can maintain extreme pressure properties for a long time and is thus most preferably used in a low viscosity lubricating oil composition for transmission like that of the present invention.

The content of Component (C) in the lubricating oil composition for transmissions according to the second aspect of the present invention is from 1 to 15 percent by mass, preferably 2 to 10 percent by mass, particularly preferably 2 to 5 percent by mass, based on the total amount of the base oil.

The base oil composed of Components (A) and (B) in the lubricating oil composition for transmission according to the first aspect of the present invention is preferably adjusted in its properties as follows with the objective of improvements in fuel economy performance and fatigue life properties.

The kinematic viscosity at 100° C. of the base oil is preferably from 2.5 to 6 $mm^2/s$, more preferably 2.5 to 4.5 $mm^2/s$, even more preferably 3 to 4 $mm^2/s$, particularly preferably 3 to 3.8 $mm^2/s$.

The sulfur content is preferably from 0.02 to 0.2 percent by mass, more preferably 0.04 to 0.15 percent by mass, particularly preferably 0.05 to 0.13 percent by mass.

The % CN is preferably from 17 to 40, more preferably 18 to 40, particularly preferably 20 to 30.

The base oil composed of Components (A), (B) and (C) in the lubricating oil composition for transmissions according to the second aspect of the present invention is preferably adjusted in its properties as follows with the objective of improvements in fuel economy performance and fatigue life properties.

The kinematic viscosity at 100° C. of the base oil is preferably from 3 to 6 $mm^2/s$, more preferably 4 to 5.5 $mm^2/s$, particularly preferably 4 to 5 $mm^2/s$.

The sulfur content is preferably from 0.02 to 0.2 percent by mass, more preferably 0.04 to 0.15 percent by mass, particularly preferably 0.05 to 0.13 percent by mass.

The % $C_N$ is preferably from 17 to 40, preferably 18 to 30, particularly preferably 20 to 25.

The lubricating oil composition for transmissions of the present invention contains a phosphorus-based extreme pressure additive, sulfur-based extreme pressure additive and/or phosphorus-sulfur-based extreme pressure additive, as Component (D).

Examples of the phosphorus-based extreme pressure additive include phosphoric acid, phosphorous acid, phosphoric acid esters having a hydrocarbon group having 2 to 30, preferably 3 to 20 carbon atoms, phosphorous acid esters having a hydrocarbon group having 2 to 30, preferably 3 to 20 carbon atoms, and salts thereof.

Examples of the sulfur-based extreme pressure additive include sulfurized fats and oils, olefin sulfides, dihydrocarbyl polysulfides, dithiocarbamates, thiadiazoles and benzothiazoles.

Examples of the phosphorus-sulfur-based extreme pressure additive include thiophosphoric acid, thiophosphorous acid, thiophosphoric acid esters having a hydrocarbon group having 2 to 30, preferably 3 to 20 carbon atoms, thiophosphorous acid esters having a hydrocarbon group having 2 to 30, preferably 3 to 20 carbon atoms, salts thereof and zinc dithiophosphates.

Component (D) is preferably an extreme pressure additive composed of at least one phosphorus-based extreme pressure additive selected from phosphorus acid, phosphorus acid monoesters, phosphorus acid diesters, phosphorus acid triesters and salts thereof; at least one sulfur-based extreme pressure additive selected from sulfurized fats and oils, olefin sulfides, dihydrocarbyl polysulfides, dithiocarbamates, thiadiazoles and benzothiazoles; and/or at least one phosphorus-sulfur-based extreme pressure additive selected from thiophosphorus acid, thiophosphorus acid monoesters, thiophosphorus acid diesters, thiophosphorus acid triesters, dithiophosphorus acid, dithiophosphorus acid monoesters, dithiophosphorus acid diesters, dithiophosphorus acid triesters, trithiophosphorus acid, trithiophosphorus acid monoesters, trithiophosphorus acid diesters, trithiophosphorus acid triesters and salts thereof.

Examples of hydrocarbon groups having 2 to 30 carbon atoms include alkyl, cycloalkyl, alkylcycloalkyl, alkenyl, aryl, alkylaryl and arylalkyl groups.

Examples of alkyl groups include straight-chain or branched alkyl groups such as ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups.

Examples of cycloalkyl groups include those having 5 to 7 carbon atoms, such as cyclopentyl, cyclohexyl and cycloheptyl groups.

Examples of alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups, of which the alkyl groups may bond to any position of the cycloalkyl groups.

Examples of alkenyl groups include butenyl, pentenyl, hexenyl, heptenyl, octenyl, noneyl, decenyl, undecenyl, dodecenyl, tridecenyl, tetradecenyl, pentadecenyl, hexadecenyl, heptadecenyl and octadecenyl groups, all of which may be straight-chain or branched and the position of which the double bonds may vary.

Examples of aryl groups include phenyl and naphtyl groups.

Examples of alkylaryl groups include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of arylalkyl groups include those having 7 to 12 carbon atoms, such as benzyl, phenylethyl, phenylpropyl, phenylbutyl, phenylpentyl, and phenylhexyl groups, of which the alkyl groups may be straight-chain or branched.

Specific preferred examples of the phosphorus-based extreme pressure additive include monobutylphosphate, monooctylphosphate, monolaurylphosphate, dibutylphosphate, dioctylphosphate, dilaurylphosphate, tributylphosphate, trioctylphosphate, trilaulylphosphate, triphenylphosphate, monobutylphosphite, monooctylphosphite, monolaurylphosphite, dibutylphosphite, dioctylphosphite, dilaurylphosphite, tributylphosphite, trioctylphosphite, trilaulylphosphite, triphenylphosphite, and salts thereof, among which phosphorus acid ester-based extreme pressure additives, particularly phosphorus acid diester-based extreme pressure additives are preferable.

Preferred examples of the phosphorus-sulfur-based extreme pressure additive include those having in their molecule 1 to 3, preferably 2 or 3, particularly preferably 3 sulfurs, such as monobutylthiophosphate, monooctylthiophosphate, monolaulylthiophosphate, dibutylthiophosphate, dioctylthiophosphate, dilaulylthiophosphate, tributylthiophosphate, trioctylthiophosphate, triphenylthiophosphate, trilaulylthiophosphate, monobutylthiophosphite, monooctylthiophosphite, monolaulylthiophosphite, dibutylthiophosphite, dioctylthiophosphite, dilaulylthiophosphite, tributylthiophosphite, trioctylthiophosphite, triphenylthiophosphite, trilaulylthiophosphite and salts thereof, among which thiophosphorus acid ester-based extreme pressure additives, particularly trithiophosphorus acid ester-based extreme pressure additives are preferable.

Examples of salts of (thio)phosphoric acid esters and (thio) phosphorous acid esters include salts obtained by allowing any of (thio)phosphoric acid monoesters, (thio)phosphoric acid diesters, (thio)phosphorous acid monoesters or (thio) phosphorous acid diesters to react with a nitrogen compound such as ammonia or an amine compound having in its molecules only a hydrocarbon or hydroxyl-containing hydrocarbon group having 1 to 8 carbon atoms or a metal base such as zinc oxide or zinc chloride so as to neutralize the whole or part of the remaining acid hydrogen.

Specific examples of nitrogen compounds include ammonia, alkylamines, of which the alkyl groups may be straight-chain or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; alkanolamines, of which the alkanol groups may be straight-chain or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

Examples of the sulfurized fats and oils include oils such as sulfurized lard, sulfurized rapeseed oil, sulfurized caster oil, sulfurized soybean oil and sulfurized rice bran oil, disulfurized fatty acid such as sulfurized oleic acid, and sulfurized esters such as sulfurized methyl oleate.

Examples of sulfurized olefins include compounds represented by formula (1):

$$R^{11}—S_x—R^{12} \quad (1)$$

In formula (1), $R^{11}$ is an alkenyl group having 2 to 15 carbon atoms, $R^{12}$ is an alkyl or alkenyl group having 2 to 15 carbon atoms and x is an integer of from 1 to 8.

A compound of this formula may be obtained by allowing an olefin having 2 to 15 carbon atoms or a dimmer to tetramer thereof to react with sulfur or a sulfurizing agent such as sulfur chloride. Preferred olefins are propylene, isobutene and diisobutene.

Dihydrocarbyl polysulfides are compounds represented by formula (2):

$$R^{13}—S_y—R^{14} \quad (2)$$

In formula (2), $R^{13}$ and $R^{14}$ are each independently an alkyl group inclusive of a cycloalkyl group, having 1 to 20 carbon atoms, an aryl group having 6 to 20 carbon atoms or an arylalkyl group having 7 to 20 carbon atoms and may be the same or different from each other and y is an integer of from 2 to 8.

Specific examples of $R^{13}$ and $R^{14}$ include methyl, ethyl, n-propyl, isopropyl, n-butyl, isobutyl, sec-butyl, tert-butyl, various types of pentyl, various types of hexyl, various types of heptyl, various types of octyl, various types of nonyl, various types of decyl, various types of dodecyl, cyclohexyl, phenyl, naphthyl, tolyl, xylyl, benzyl and phenetyl groups.

Specific preferred examples of dihydrocarbyl polysulfides include dibenzyl polysulfide, di-tert-nonyl polysulfide, didodecyl polysulfide, di-tert-butyl polysulfide, dioctyl polysulfide, diphenyl polysulfide and dicyclohexyl polysulfide.

Specific examples of dithiocarbamates include compounds represented by the following formulas:

(3)

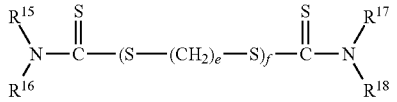

(4)

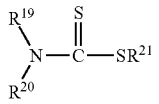

In formulas (3) and (4), $R^{15}$, $R^{16}$, $R^{17}$, $R^{18}$, $R^{19}$ and $R^{20}$ are each independently a hydrocarbon group having 1 to 30, preferably 1 to 20 carbon atoms, $R^{21}$ is hydrogen or a hydrocarbon group having 1 to 30 carbon atoms, preferably hydrogen or a hydrocarbon group having 1 to 20 carbon atoms, e is an integer of from 0 to 4, and f is an integer of from 0 to 6.

Examples of the hydrocarbon group having 1 to 30 carbon atoms include alkyl, cycloalkyl, alkylcycloalkyl, alkenyl, aryl, alkylaryl and arylalkyl groups.

Examples of thiadiazoles include 1,3,4-thiadiazole compounds represented by formula (5) 1,2,4-thiadiazole compounds represented by formula (6) and 1,4,5-thiadiazole compounds represented by formula (7):

(5)

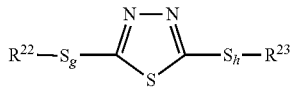

(6)

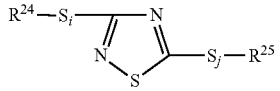

(7)

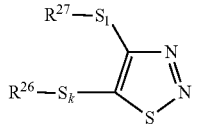

In formulas (5) to (7), $R^{22}$, $R^{23}$, $R^{24}$, $R^{25}$, $R^{26}$ and $R^{27}$ may be the same or different from each other and are each independently hydrogen or a hydrocarbon group having 1 to 30 carbon atoms and g, h, i, j, k and l are each independently an integer of from 0 to 8.

Examples of the hydrocarbon groups having 1 to 30 carbon atoms include alkyl, cycloalkyl, alkylcycloalkyl, alkenyl, aryl, alkylaryl and arylalkyl groups.

In the present invention, Component (D) is preferably a phosphorus acid diester-based extreme pressure additive such as di-2-ethylhexylphosphite, a sulfur-based extreme pressure additive such as olefin sulfides and diadiazoles and/or a trithiophosphorus acid triester-based extreme pressure additive such as trilaulyltrithiophosphite because they can improve fatigue life properties.

The content of Component (D) is from 0.05 to 2 percent by mass and preferably 0.1 to 1 percent by mass with the objective of fatigue life properties, extreme pressure properties, anti-wear properties and oxidation stability. However, in order to further enhance fatigue life properties, the content of Component (D) is more preferably from 0.01 to 0.05 percent by mass and even more preferably 0.02 to 0.04 percent by mass in terms of phosphorus and is preferably from 0.01 to 0.25 percent by mass, preferably 0.02 to 0.15 percent by mass, particularly preferably 0.07 to 0.12 percent by mass in terms of sulfur. The mass ratio of phosphorus to sulfur (P/S) contained in Component (D) is assumed to have the optimum range and is preferably from 0.13 to 2, more preferably 0.2 to 1, particularly preferably 0.2 to 0.5 although the ratio may vary depending on the sulfur content in Component (B).

The lubricating oil composition for transmissions of the present invention may contain one or more high-viscosity synthetic lubricating oils selected from those other than Component (C) such that the composition can be provided with excellent fatigue life properties and excellent extreme pressure properties at an initial stage and after a long period of use. Such high-viscosity synthetic lubricating oils are those having a kinematic viscosity at 100° C. of from 40 to 500 $mm^2/s$, preferably 50 to 450 $mm^2/s$, more preferably 80 to 400 $mm^2/s$, even more preferably 90 to 350 $mm^2/s$. A high-viscosity synthetic lubricating oil with a kinematic viscosity at 100° C. of less than 40 $mm^2/s$ is not preferable because it has a less effect on improvements in fatigue life properties and initial extreme pressure properties. A high-viscosity synthetic oil with a kinematic viscosity at 100° C. of 500 $mm^2/s$ or less can provide the lubricating oil composition with improved fatigue life properties and extreme pressure properties after long-term use.

No particular limitation is imposed on the viscosity index of the high-viscosity synthetic lubricating oils. However, the viscosity index is preferably 150 or greater, more preferably 160 or greater, and preferably 400 or less, more preferably 280 or less, particularly preferably 260 or less. No particular limitation is imposed on the pour point. However, the pour point is preferably −10° C. or lower, more preferably −20° C. or lower, particularly preferably −30° C. or lower so as not to adversely affect the low-temperature properties of the lubricating oil composition.

The amount of the above-described high-viscosity synthetic oil if blended is preferably from 1 to 15 percent by mass, more preferably 2 to 10 percent by mass, based on the total amount of the base oil in order to provide the lubricating oil composition for transmissions, which is though of low viscosity, with excellent fatigue life properties and excellent extreme pressure properties at an initial stage and after long-term use.

The high-viscosity synthetic oil may be a mixture of two or more types of high-viscosity synthetic oils. The mixing ratio of such a mixture may be arbitrarily selected.

Specific examples of the high-viscosity synthetic lubricating oil include those having a kinematic viscosity at 100° C. of from 40 to 500 $mm^2/s$, such as isoparaffins, alkylbenzenes, alkylnaphthalenes, polyesters, polyoxyalkylene glycols, dialkyl diphenyl ethers and polyphenyl ethers.

Specific examples of the polyester-based lubricating oil include an ester of a polyhydric alcohol having a neopentyl structure, such as neopentyl glycol, trimethylol propane and pentaerythritol with a monocarboxylic acid or a polycarboxylic acid and a complex ester obtained by bringing such a monocarboxylic acid ester or polycarboxylic acid into an esterification reaction or an ester-exchange reaction and adjusting the polymerization degree of the resulting product such that the kinematic viscosity at 100° C. is adjusted to 40 to 500 $mm^2/s$. The polyester-based lubricating oil may contain an alkyleneoxide or polyalkyleneoxide in its molecules.

Examples of monocarboxylic acids include straight chain fatty acids such as butyric acid, valerianic acid, caproic acid, enanthic acid, caprylic acid, pelargonic acid, capric acid, lauric acid, myristic acid, palmitic acid, stearic acid, oleic acid, linoleic acid, linolenic acid and erucic acid; branched fatty acids such as 2-ethylhexanoic acid, isooctyl acid, isononanoic acid, isocapric acid, isolauric acid, isomyristic acid, isopalmitic acid, isostearic acid, isoarachidic acid, synthetic fatty acids obtained by the Koch's method and fatty acids derived from synthetic alcohols by the Guerbet's method; and mixtures thereof.

Examples of polycarboxylic acids include dibasic acids such as oxalic acid, malonic acid, succinic acid, glutaric acid, adipic acid, pimelic acid, azelaic acid, sebacic acid, dodecane-1,12-dicarboxylic acid, brassylic acid, dimer acid, phthalic acid, isophthalic acid and terephthalic acid; tribasic acids such as propylene-1,2,3-tricarboxylic acid, propane-1,2,3-tricarboxylic acid, 2-oxypropane-1,2,3-tricarboxylic acid, 4-oxypentane-1,3,4-tricarboxylic acid, 2-oxyheptadecane-1,2,3-tricarboxylic acid, hemimellitic acid, trimellitic acid and trimesic acid; prehnitic acid; mellophanic acid; pyromellitic acid; and mixtures thereof. Particularly preferred are dibasic acids such as adipic acid, azelaic acid, dodecane-1,12-dicarboxylic acid and dimer acid.

Examples of carboxylic acid esters and polycarboxylic acid esters include esters of the above-mentioned carboxylic acids or polycarboxylic acids with lower alcohols such as methanol, ethanol and octanol.

The method of producing the above-mentioned complex ester may be a method wherein the above-mentioned reaction is conducted in a single or multiple steps at a temperature of from 100 to 250° C., preferably 140 to 240° C. and purification is conducted by distilling out the unreacted product, removing the catalyst and heat-dehydrating the remaining product under vacuum after being washed with water. The method may be conducted using toluene, benzene or xylene as an azeotropic dehydration solvent. Furthermore, the reaction may be conducted under an inert gas atmosphere such as of nitrogen introduced for purposes of removing the reacted water or under vacuum. A catalyst which may be used in this method is an acid catalyst such as sulfuric acid and paratoluene sulfonic acid, an alkali catalyst such as potassium oxide, lithium oxide and lithium acetate and a metallic oxide such as zinc oxide.

Examples of polyoxyalkylene glycols include those such as polyoxypropylene glycols synthesized by ring opening polymerization or copolymerization of alkyleneoxides having 2 to 10, preferably 3 to 5 carbon atoms, such as ethyleneoxide, propyleneoxide, trimethyleneoxide, butyleneoxide, α-methyl-trimethyleneoxide, 3,3'-dimethyl-trimethyleneoxide, tetrahydrofuran, dioxane and mixtures thereof such that the kinematic viscosity at 100° C. is adjusted to 40 to 500 $mm^2/s$ by selection of the polymerization degree, or polyoxyalkylene glycol ethers such as alkyl ethers, aryl ethers, alkylaryl ethers and arylalkyl ethers of such polyoxyalkylene glycols, having a substituent having 1 to 20 carbon atoms.

For purposes of further enhancing fatigue life properties, extreme pressure properties after long-term use, antiwear properties or low temperature flowability, the lubricating oil composition for transmissions of the present invention may contain a non dispersion type viscosity index improver and/or a dispersion type viscosity index improver, each having a weight average molecular weight of 50,000 or less, preferably 40,000 or less, most preferably from 10,000 to 35,000.

Specific examples of non dispersion type viscosity index improvers include homopolymers of (E-1) monomers selected from the group consisting of compounds represented by formulas (8), (9) and (10) below, copolymers of two or more of (E-1) monomers, and hydrides thereof:

(8)

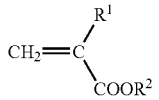

(9)

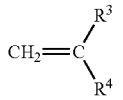

(10)

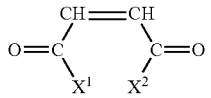

Specific examples of dispersion type viscosity index improvers include copolymers of two or more of (E-2) monomers selected from the group consisting of compounds represented by formulas (11) and (12) below and hydrides thereof; and copolymers of one or more of (E-1) monomers selected from the group consisting of compounds represented by formulas (8), (9) and (10) above with one or more of (E-2) monomers selected from the group consisting of compounds represented by formulas (11) and (12) below and hydrides thereof:

(11)

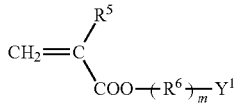

(12)

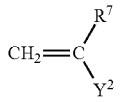

In formula (8) above, $R^1$ is hydrogen or methyl, and $R^2$ is hydrogen or an alkyl group having 1 to 18 carbon atoms.

Specific examples of alkyl groups having 1 to 18 carbon atoms for $R^2$ include those, which may be straight-chain or branched, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups.

In formula (9) above, $R^3$ is hydrogen or methyl, and $R^4$ is hydrogen or a hydrocarbon group having 1 to 12 carbon atoms.

Specific examples of hydrocarbon groups having 1 to 12 carbon atoms for $R^4$ include alkyl groups, which may be straight-chain or branched, such as methyl, ethyl, propyl, butyl, pentyl, hexyl, heptyl, octyl, nonyl, decyl, undecyl and dodecyl groups; cycloalkyl groups having 5 to 7 carbon atoms, such as cyclopentyl, cyclohexyl and cycloheptyl groups; alkylcycloalkyl groups, of which the alkyl groups may bond to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; alkenyl groups, which may be straight-chain or branched and the position of which the double bond may vary, such as butenyl, pentenyl, hexenyl, heptenyl, octenyl, nonenyl, decenyl, undecenyl and dodecenyl groups; aryl groups such as phenyl and naphtyl groups; alkylaryl groups, of which the alkyl groups may be straight-chain or branched and bond to any position of the aryl group, having 7 to 12 carbon groups, such as tolyl, xylyl, ethylphenyl, propylphenyl, butylphenyl, pentylphenyl and hexylphenyl groups; and arylalkyl groups, of which the alkyl groups may be straight-chain or branched, having 7 to 12 carbon atoms, such as benzyl, phenylethyl, phenylpropyl, phneylbutyl, phenylpentyl and phenylhexyl groups.

In formula (10) above, $X^1$ and $X^2$ are each independently hydrogen, an alkoxy group having 1 to 18 carbon atoms represented by the formula —$OR^9$ wherein $R^9$ is an alkyl group having 1 to 18 carbon atoms, or a monoalkylamino group having 1 to 18 carbon atoms represented by the formula —$NHR^{10}$ wherein $R^{10}$ is an alkyl group having 1 to 18 carbon atoms.

In formula (11) above, $R^5$ is hydrogen or methyl, $R^6$ is an alkylene group having 1 to 18 carbon atoms, $y^1$ is an amine residue or heterocyclic residue having 1 or 2 nitrogens and 0 to 2 oxygens, and m is an integer of 0 or 1.

Specific examples of alkylene groups having 1 to 18 carbon atoms for $R^6$ include ethylene, propylene, butylene, pentylene, hexylene, heptylene, octylene, nonylene, decylene, undecylene, dodecylene, tridecylene, tetradecylene, pentadecylene, hexadecylene, heptadecylene and octadecylene groups, all of which may be straight-chain or branched.

Specific examples of groups represented by $y^1$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrolidinyl, piperidinyl, quinonyl, pyrrolidonyl, pyrrolidono, imidazolino and pyrazino groups.

In formula (12), $R^7$ is hydrogen or methyl, and $y^2$ is an amine residue or heterocyclic residue having 1 or 2 nitrogens and 0 to 2 oxygens.

Specific examples of groups represented by $y^2$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrolidinyl, piperidinyl, quinonyl, pyrrolidonyl, pyrrolidono, imidazolino and pyrazino groups.

Preferred examples of monomers (E-1) include alkylacrylates having 1 to 18 carbon atoms; alkylmethacrylates having 1 to 18 carbon atoms; olefins styrene, methylstyrene, maleic anhydride ester and maleic anhydride amide, each having 2 to 20 carbon atoms, and mixtures thereof.

Preferred examples of monomers (E-2) include dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone, and mixtures thereof.

When one or more monomers selected from (E-1) compounds are copolymerized with one or more monomers selected from (E-2) compounds, the copolymerization molar ratio "(E-1): (E-2)" is within the range of 80:20 to 95:5. Although no particular limitation is imposed on the copolymerization method, such copolymers are generally obtained with ease by radical-solution polymerization of monomers (E-1) with monomers (E-2) in the presence of a polymerization initiator such as benzoyl peroxide.

Specific examples of the viscosity index improvers which may be blended in the lubricating oil composition of the present invention include non dispersion type or dispersion type polymethacrylates, non dispersion type or dispersion type ethylene-α-olefin copolymers and hydrides thereof, polyisobutylene and hydrides thereof, styrene-diene hydrogenated copolymers, styrene-maleic anhydride ester copolymers, and polyalkylstyrenes.

Preferred viscosity index improvers which can be blended with the lubricating oil composition of the present invention are ethylene-α-olefin copolymers having a number average molecular weight of from 2,000 to 20,000, preferably 10,000 to 18,500 because they are extremely excellent in an improvement in fatigue life properties and polymethacrylate-based viscosity index improvers because they are more excellent in low-temperature flowability.

When the viscosity index improver is blended with the lubricating oil composition of the present invention, the amount of the improver is from 0.1 to 15 percent by mass, preferably 0.5 to 5 percent by mass based on the total amount of the composition. The amount of the viscosity index improver in excess of 15 percent by mass is not preferable because of causing a difficulty in maintaining the initial extreme pressure properties of the composition for a long period of time.

The lubricating oil composition of the present invention is preferably blended with at least one type of additive selected from the group consisting of ashless dispersants, alkaline earth metal-based detergents, antioxidants and friction modifiers.

Examples of ashless dispersants include the following nitrogen compounds which may be used alone or in combination:

(F-1) succinimides having in their molecules at least one alkyl or alkenyl group having 40 to 400 carbon atoms and derivatives thereof;

(F-2) benzylamines having in their molecules at least one alkyl or alkenyl group having 40 to 400 carbon atoms and derivatives thereof; and (F-3) polyamines having in their molecules at least one alkyl or alkenyl group having 40 to 400 carbon atoms and derivatives thereof.

Specific examples of (F-1) succinimides include compounds represented by formulas (13) and (14):

(13)

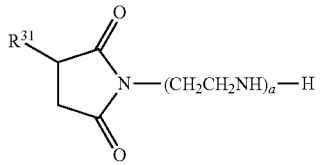

(14)

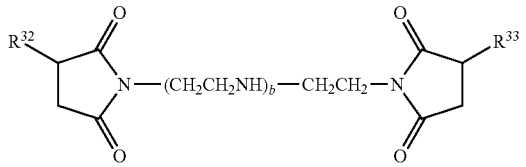

In formula (13), $R^{31}$ is an alkyl or alkenyl group having 40 to 400, preferably 60 to 350 carbon atoms, and a is an integer of from 1 to 5, preferably 2 to 4.

In formula (14), $R^{32}$ and $R^{33}$ are each independently an alkyl or alkenyl group having 40 to 400, preferably 60 to 350 carbon atoms, and b is an integer of from 0 to 4, preferably 1 to 3.

The above-described succinimides include mono type succinimides wherein a succinic anhydride is added to one end of a polyamine by imidization, as represented by formula (13)

and bis type succinimides wherein a succinic anhydride is added to both ends of a polyamine by imidization, as represented by formula (14). The lubricating oil composition of the present invention may contain either type of the succinimides or a mixture thereof.

Specific examples of (F-2) benzylamines include compounds represented by formula (15):

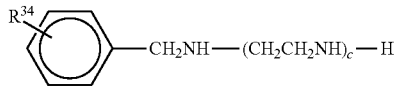

(15)

In formula (15), $R^{34}$ is an alkyl or alkenyl group having 40 to 400, preferably 60 to 350 carbon atoms, and c is an integer of from 1 to 5, preferably 2 to 4.

The above-described benzylamine may be obtained by reacting a polyolefin such as a propylene oligomer, polybutene or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine or pentaethylenehexamine.

Specific examples of (F-3) polyamines include compounds represented by formula (16):

$$R^{35}—NH—(CH_2CH_2NH)_d—H \quad (16)$$

In formula (16), $R^{35}$ is an alkyl or alkenyl group having 40 to 400, preferably 60 to 350, and d is an integer of from 1 to 5, preferably 2 to 4.

The above-described polyamine may be produced by chlorinating a polyolefin such as a propylene oligomer, polybutene or ethylene-α-olefin copolymer and reacting the chlorinated polyolefin with ammonia or a polyamine such as ethylenediamine, diethylenetriamine, triethylenetetramine, tetraethylenepentamine and pentaethylenehexamine.

No particular limitation is imposed on the nitrogen content of the above-described nitrogen compounds. However, the nitrogen content is preferably from 0.01 to 10 percent by mass, more preferably 0.1 to 10 percent by mass with the objective of antiwear properties, oxidation stability and friction properties.

Examples of derivatives of the above-described nitrogen compounds include acid-modified compounds obtained by allowing any of the above-described nitrogen-containing compounds to react with a monocarboxylic acid having 2 to 30 carbon atoms, such as fatty acid or a polycarboxylic acid having 2 to 30 carbon atoms, such as oxalic acid, phthalic acid, trimellitic acid, and pyromellitic acid so as to neutralize or amidize the whole or a part of the remaining amino and/or imino groups; boron-modified compounds obtained by allowing any of the above-described nitrogen-containing compounds to react with boric acid so as to neutralize or amidize the whole or a part of the remaining amino and/or imino groups; sulfur-modified compounds obtained by allowing any of the above-described nitrogen-containing compounds to react with a sulfuric compound; and modified products obtained by a combination of two or more modifications selected from the acid modification, boron modification and sulfur modification, of the above-described nitrogen-containing compounds.

No particular limitation is imposed on the amount of the ashless dispersant. However, the amount is preferably from 0.5 to 10.0 percent by mass, more preferably 1 to 8.0 percent by mass. The ashless dispersant of less than 0.5 percent by mass is less effective in improvements in fatigue life properties and extreme pressure properties, while the ashless dispersant of more than 10.0 percent by mass extremely deteriorates the low temperature flowability of the resulting composition.

Blend of an alkaline earth metal-based detergent in the composition of the present invention can improve the fatigue life properties and extreme pressure properties at an initial stage and after long-term use.

The alkaline earth metal-based detergent which may be used in the present invention is preferably a basic metallic detergent whose base number is from 20 to 450 mgKOH/g, preferably 50 to 400 mgKOH/g. The term "base number" used herein denotes a base number measured by the perchloric acid potentiometric titration method in accordance with section 7 of JIS K2501 "Petroleum products and lubricants-Determination of neutralization number". An alkaline earth metal-based detergent with a base number of less than 20 mgKOH/g is insufficient in improvements in fatigue life properties and extreme pressure properties, while an alkaline earth metal-based detergent with a base number of more than 450 mgKOH/g renders the structure of the composition unstable and thus deteriorates the storage stability thereof.

Specific examples of the alkaline earth metal-based detergent with a base number of from 20 to 450 mgKOH/g include (F-4) alkaline earth metal sulfonates, (F-5) alkaline earth metal phenates and (F-6) alkaline earth metal salicylates. One or more types of these detergents may be used in the present invention.

Specific examples of (F-4) alkaline earth metal sulfonates include alkaline earth metal salts, preferably magnesium and/or calcium salts, of alkyl aromatic sulfonic acids obtained by sulfonating alkyl aromatic compounds having a molecular weight of from 100 to 1,500, preferably 200 to 700. Specific examples of alkyl aromatic sulfonic acids include petroleum sulfonic acids and synthetic sulfonic acids.

Petroleum sulfonic acids may be those obtained by sulfonating an alkyl aromatic compound contained in the lubricant fraction of a mineral oil or mahogany acid by-produced upon production of white oil. Synthetic sulfonic acids may be those obtained by sulfonating an alkyl benzene having a straight-chain or branched alkyl group, produced as a by-product from a plant for producing an alkyl benzene used as the raw materials of detergents or obtained by alkylating a polyolefin to benzene, or those obtained by sulfonating an dinonylnaphthalene. Sulfonating agents used for sulfonating these alkyl aromatic compounds may be fuming sulfuric acids and sulfuric acid.

Specific examples of (F-5) alkaline earth metal phenates include alkaline earth metal salts, preferably magnesium salts and/or calcium salts, of an alkylphenol having at least one straight-chain or branched alkyl group having 4 to 30, preferably 6 to 18 carbon atoms, alkylphenolsulfides obtained by reacting the alkylphenol with sulfur, or Mannich reaction products obtained by reacting the alkylphenol with formaldehyde.

Specific examples of (F-6) alkaline earth metal salicylates include alkaline earth metal salts, particularly preferably magnesium salts and/or calcium salts, of alkyl salicylic acids having at least one straight-chain or branched alkyl group having 4 to 30, preferably 6 to 18 carbon atoms.

As long as the above-described alkaline earth metal sulfonates, phenates and salicylates each have a base number of from 20 to 450 mgKOH/g, they may be a neutral salt (normal salt) obtained by reacting an alkyl aromatic sulfonic acid, alkylphenol, alkylphenolsulfide, Mannich reaction product of alkylphenol or alkylsalicylic acid directly with a alkaline earth metal base such as an alkaline earth metal oxide or hydroxide of magnesium and/or calcium or once converting an alkyl aromatic sulfonic acid, alkylphenol, alkylphenolsulfide, Mannich reaction product of an alkylphenol or alkylsalicylic acid to an alkali metal salt such as a sodium salt or potassium salt and then substituting the alkali metal salt with an alkaline earth metal salt; a basic salt obtained by heating such a neutral salt with an excess amount of an alkaline earth metal salt or alkaline earth metal base (alkaline earth metal hydroxide or oxide) in the presence of water; and an overbased salt (superbasic salt) obtained by reacting such a neutral salt with an alkaline earth metal base in the presence of carbonic acid gas. These reactions are usually conducted in a solvent (an aliphatic hydrocarbon solvent such as hexane, aromatic hydrocarbon solvent such as xylene, and light lubricating base oil). Although metallic detergents are usually commercially available as diluted with a light lubricating base oil, it is preferable to use such metallic detergents whose metal content is within the range of 1.0 to 20 percent by mass and preferably 2.0 to 16 percent by mass.

No particular limitation is imposed on the amount of the alkaline earth metal-based detergent. However, the amount is preferably from 0.05 to 4.0 percent by mass and more preferably 0.1 percent by mass, and 3.0 percent by mass or less, preferably 1 percent by mass or less, particularly preferably 0.5 percent by mass or less. The alkaline earth metal-based detergent of less than 0.05 percent by mass is insufficient in improvements in fatigue life properties and extreme pressure properties, while that of more than 4.0 percent by mass reduces the oxidation stability of the resulting composition.

Eligible antioxidants are phenol-based antioxidants and amine-based antioxidants as long as they are generally used in lubricating oils. They are preferably used in combination.

Specific examples of such antioxidants include alkylphenols such as 2-6-di-tert-butyl-4-methylphenol; bisphenols such as methylene-4,4-bisphenol(2,6-di-tert-butyl-4-methylphenol); naphthylamines such as phenyl-α-naphthylamine; dialkyldiphenylamines; zinc dialkyldithiophosphates such as zinc di-2-ethylhexyldithiophosphate; and esters of (3,5-di-tert-butyl-4-hydroxyphenyl)fatty acid (propionic acid) or (3-methyl-5-tert-butyl-4-hydroxyphenyl)fatty acid (propionic acid) with a monohydric or polyhydric alcohol such as methanol, octanol, octadecanol, 1,6-hexanediol, neopentyl glycol, thiodiethylene glycol, triethylene glycol and pentaerythritol.

One or more compounds selected from these antioxidants may be blended in an arbitrary amount, but is usually blended in an amount of from 0.01 to 5.0 percent by mass.

The friction modifier may be any one of those for lubricating oils but is preferably an amine compound, imide compound, fatty acid ester, fatty acid amide or fatty acid metal salt, each having in its molecules an alkyl or alkenyl group having 6 to 30 carbon atoms, particularly a straight-chain alkyl or alkenyl group having 6 to 30 carbon atoms.

Examples of the amine compound include straight-chain or branched, preferably straight-chain aliphatic monoamines having 6 to 30 carbon atoms; straight-chain or branched, preferably straight-chain aliphatic polyamines having 6 to 30 carbon atoms; and alkyleneoxide adducts of such aliphatic amines. Examples of the imide compound include succinimides having a straight-chain or branched alkyl or alkenyl group having 6 to 30 carbon atoms and/or modified products thereof with a carboxylic acid, boric acid phosphoric acid or sulfuric acid. Examples of the fatty acid ester include esters of straight-chain or branched, preferably straight-chain fatty acids having 7 to 31 carbon atoms with aliphatic monohydric alcohols or aliphatic polyhydric alcohols. Examples of the fatty acid amides include amides of straight-chain or branched, preferably straight-chain fatty acids having 7 to 31 carbon atoms with aliphatic monoamines or aliphatic polyamines. Examples of the fatty acid metal salts include alkaline earth metal salts (magnesium salts or calcium salts) or zinc salts of straight-chain or branched, preferably straight-chain fatty acids having 7 to 31 carbon atoms.

The composition of the present invention contains preferably one or more friction modifiers selected from amine-, ester-, amide- and fatty acid-based friction modifiers, particularly preferably one or more friction modifiers selected from amine-, amide- and fatty acid-based friction modifiers because they can improve fatigue life properties better.

One or more compounds selected from the above-described friction modifiers may be blended in the composition in an arbitrary amount, but is usually blended in an amount of 0.01 to 5.0 percent by mass and preferably 0.03 to 3.0 percent by mass based on the total amount of the composition.

For purposes of further enhancing the properties of the composition of the present invention, the composition may be blended with one or more of various additives other than those described above, such as corrosion inhibitors, rust inhibitors, demulsifiers, metal passivators, pour point depressants, rubber swelling agents, antifoamers and dyes if necessary.

Examples of corrosion inhibitors include benzotriazole-, tolyltriazole-, thiadiazole- and imidazole-based compounds.

Examples of rust inhibitors include petroleum sulfonates, alkylbenzene sulfonates, dinonylnaphthalene sulfonates, alkenyl succinic acid esters and polyhydric alcohol esters.

Examples of demulsifiers include polyalkylene glycol-based non-ionic surfactants such as polyoxyethylenealkyl ethers, polyoxyethylenealkylphenyl ethers and polyoxyethylenealkylnaphthyl ethers.

Examples of metal passivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole and β-(o-carboxybenzylthio)propionitrile.

Pour point depressants may be any of known pour point depressants selected depending on the type of lubricating base oil but are preferably polymethacrylates having a weight average molecular weight of more than 50,000 and 150,000 or less, preferably from 80,000 to 120,000.

Antifoamers may be any compound generally used as an antifoamers for lubricating oils, including silicones such as dimethylsilicone and fluorosilicone. One or more arbitrarily selected from such silicones may be blended in an arbitrary amount.

Dyes may be any compounds generally used as dyes for lubricating oil and may be blended in an arbitrary amount but in an amount of usually from 0.001 to 1.0 percent by mass based on the total amount of the composition.

When these additives are contained in the lubricating oil composition of the present invention, the corrosion inhibitor, rust inhibitor and demulsifier are each contained in an amount of from 0.005 to 5 percent by mass, the metal passivator is contained in an amount of from 0.005 to 1 percent by mass, the pour point depressant is contained in an amount of from 0.05 to 1 percent by mass, the antifoamer is contained in an amount of from 0.0005 to 1 percent by mass, and the dye is contained in an amount of from 0.001 to 1.0 percent by mass based on the total amount of the composition.

The total sulfur content (the total amount of sulfur contained in the extreme pressure additive, lubricating base oil and other additives) is from 0.05 to 0.3 percent by mass, preferably 0.1 to 0.2 percent by mass, particularly preferably 0.12 to 0.18 percent by mass with the objective of fatigue life properties and oxidation stability.

The mass ratio (P/S) of the phosphorus content (contained in the extreme pressure additive) to the total sulfur content in the composition of the present invention is necessarily from 0.10 to 0.40, preferably 0.12 to 0.3, more preferably 0.15 to 0.25.

The transmission lubricating oil composition of the present invention with the above-described components can be provided with excellent fatigue life properties due to the above-described component structure. However, in order to further improve the composition of the present invention in fuel economy performance due to the reduction of the stirring resistance compared with conventional lubricating oil compositions for automatic, continuously variable or manual transmissions, the composition of the present invention has a kinematic viscosity at 100° C. of preferably 10 $mm^2/s$ or less, more preferably 8 $mm^2/s$ or less, even more preferably 7 $mm^2/s$ or, less, particularly preferably 6.5 $mm^2/s$ or less. The kinematic viscosity at 40° C. of the composition is preferably 40 $mm^2/s$ or less, more preferably 35 $mm^2/s$ or less, particularly preferably 30 $mm^2/s$ or less. In order to further enhance the extreme pressure properties for automatic transmissions, continuously variable transmissions and manual transmission, the kinematic viscosity at 100° C. of the composition is 3 $mm^2/s$ or greater, more preferably 4 $mm^2/s$ or greater, particularly preferably 5 $mm^2/s$ or greater, and the kinematic viscosity at 40° C. of the composition is preferably 15 $mm^2/s$ or greater, more preferably 20 $mm^2/s$ or greater.

The transmission lubricating oil composition of the present invention has a low viscosity but is still excellent in fatigue life properties, low-temperature viscosity and oxidation stability and can reduce the stirring resistance caused by a lubricating oil. Therefore, the use of the composition of the present invention in transmissions of automobiles, particularly automatic, continuously variable or manual transmissions or final reduction gear units of automobiles is contributive to an improvement in the fuel economy performance of automobiles.

BEST MODES FOR CARRYING OUT THE INVENTION

Hereinafter, the present invention will be described in more details by way of the following examples and comparative examples, which should not be construed as limiting the scope of the invention.

Examples 1 to 9, and Comparative Examples 1 to 3

Lubricating oil compositions of the present invention (Examples 1 to 9) and those for comparison (Comparative Example 1 to 3) were prepared by blending various lubricating base oils and additives as set forth in Table 1 below. The content of each additive is based on the total amount of the composition.

The fatigue life properties of each of the resulting compositions were evaluated by a fatigue life test described in (1) below. The results of the evaluation are also set forth in Table 1.

Examples 10 to 17, Reference Example 1 and Comparative Examples 4 to 7

Lubricating oil compositions of the present invention (Examples 10 to 17), that for reference (Reference Example 1) and those for comparison (Comparative Example 4 to 7) were prepared by blending various lubricating base oils and additives as set forth in Table 2 below. The content of each additive is based on the total amount of the composition.

The fatigue life properties, low temperature viscosity and oxidation stability of each of the resulting compositions were evaluated by methods described in (1) to (3) below. The results of the evaluations are also set forth in Table 2.

(1) Fatigue Life Test

The fatigue life was measured using a rolling fatigue tester as follows.

(Bearing)

Material: bearing steel

Test sample piece: ϕ60 mm×5 mm in thickness

Size of a test steel ball: ϕ⅜ inch (Test conditions)

Number of revolutions: 1800 rpm

Oil temperature: 150° C.

Surface pressure 6.4 GPa (Evaluation criterion)

Time consumed until surface damages such as pitching appear was evaluated as fatigue life, and L50 (average) was calculated from 6 times test results.

(2) Brookfield Viscosity

The Brookfield viscosity at −40° C. of each composition was measured in accordance with ASTM D 2983. The result is also set forth in Table 2. A composition with a Brookfield viscosity at −40° C. of 20,000 mPa·s or less is regarded as excellent in low temperature viscosity.

(3) Oxidation Stability

Each of the compositions was forced to deteriorate at 165.5° C. in an ISOT test in accordance with JIS K 2514, and the increase of acid number after the lapse of 72 hours was measured. A composition with a less increase in acid number is regarded as excellent in oxidation stability.

TABLE 1

| | | | | Examples | | | | | | | | | Comparative Examples | | |
|---|---|---|---|---|---|---|---|---|---|---|---|---|---|---|---|
| | | | | 1 | 2 | 3 | 4 | 5 | 6 | 7 | 8 | 9 | 1 | 2 | 3 |
| Composition - mass(%) | Base oil (A) based on the total amount of the base oil | Hydro-refined mineral oil A 1) | mass % | 50 | 70 | 70 | 52 | 45 | 65 | 65 | 65 | 65 | 70 | 65 | 65 |
| | | Hydro-refined mineral oil B 2) | mass % | 40 | 10 | | | 25 | 25 | 25 | 25 | 25 | 30 | 25 | 25 |
| | | Naphthene-based mineral oil A 3) | mass % | | | | | 20 | | | | | | | |
| | | Synthetic base oil A 4) | mass % | | | | 38 | | | | | | | | |
| | | Kinematic viscosity at 100° C. | $mm^2/s$ | 3.2 | 2.7 | 2.6 | 3.2 | 3.2 | 2.9 | 2.9 | 2.9 | 2.9 | 2.7 | 2.9 | 2.9 |
| | | % $C_N$ | | 20.8 | 20.3 | 20.0 | 15.5 | 26.2 | 20.6 | 20.6 | 20.6 | 20.6 | 20.5 | 20.6 | 20.6 |
| | | Sulfur content | mass % | <0.001 | <0.001 | <0.001 | <0.001 | 0.012 | <0.001 | <0.001 | <0.001 | <0.001 | <0.001 | <0.001 | <0.001 |
| | Base oil (B) based on the total amount of the base oil | Solvent-refined mineral oil B 5) | mass % | 10 | 20 | 30 | 10 | 10 | | | | | | | |
| | | Solvent-refined mineral oil C 6) | mass % | | | | | | 10 | 10 | 10 | 10 | | 10 | 10 |
| | Properties of the base oil | Kinematic viscosity at 100° C. | $mm^2/s$ | 3.5 | 3.4 | 3.7 | 3.9 | 3.5 | 3.5 | 3.5 | 3.5 | 3.5 | 2.7 | 3.5 | 3.5 |
| | | % $C_N$ | | 21.3 | 21.2 | 21.5 | 16.5 | 26.1 | 20.8 | 20.8 | 20.8 | 20.8 | 20.6 | 20.8 | 20.8 |
| | | Sulfur content | mass % | 0.06 | 0.11 | 0.17 | 0.06 | 0.08 | 0.05 | 0.05 | 0.05 | 0.05 | 0.00 | 0.05 | 0.05 |
| | Extreme pressure additive (D) based on the total amount of the composition | Phosphorus-based extreme pressure additive A 7) | mass % | 0.3 | 0.3 | 0.3 | 0.3 | 0.3 | 0.3 | 0.3 | 0.3 | | 0.3 | 0.3 | 0.3 |
| | | Phosphorus-sulfur-based extreme pressure additive A 8) | mass % | | | | | | | | | 0.6 | | | |
| | | Sulfur-based extreme pressure additive A 9) | mass % | 0.1 | 0.1 | 0.1 | 0.1 | 0.1 | 0.1 | 0.2 | | | 0.1 | 0.6 | |
| | | Sulfur-based extreme pressure additive B 10) | mass % | | | | | | | | 0.15 | | | | |
| | | Phosphorus content | mass % | 0.03 | 0.03 | 0.03 | 0.03 | 0.03 | 0.03 | 0.03 | 0.03 | 0.03 | 0.03 | 0.03 | 0.03 |
| | | Sulfur content | mass % | 0.05 | 0.05 | 0.05 | 0.05 | 0.05 | 0.05 | 0.09 | 0.05 | 0.10 | 0.05 | 0.27 | 0.00 |
| | Other additives based on the total amount of the composition | Viscosity index improver A 11) | mass % | 4 | 4 | 3 | 2 | 4 | 4 | 4 | 4 | 4 | 8 | 4 | 4 |
| | | Ashless dispersant A 12) | mass % | 3 | 3 | 3 | 3 | 3 | 3 | 3 | 3 | 3 | 3 | 3 | 3 |
| | | Ashless dispersant B 13) | mass % | 1 | 1 | 1 | 1 | 1 | 1 | 1 | 1 | 1 | 1 | 1 | 1 |
| | | Alkaline earth metal-based detergent 14) | mass % | 0.4 | 0.4 | 0.4 | 0.4 | 0.4 | 0.4 | 0.4 | 0.4 | 0.4 | 0.4 | 0.4 | 0.4 |
| | | Friction modifier B 15) | mass % | 0.1 | 0.1 | 0.1 | 0.1 | 0.1 | 0.1 | 0.1 | 0.1 | 0.1 | 0.1 | 0.1 | 0.1 |
| | | Anti-oxidant B 16) | mass % | 0.5 | 0.5 | 0.5 | 0.5 | 0.5 | 0.5 | 0.5 | 0.5 | 0.5 | 0.5 | 0.5 | 0.5 |
| | | Antifoamer A 17) | mass % | 0.002 | 0.002 | 0.002 | 0.002 | 0.002 | 0.002 | 0.002 | 0.002 | 0.002 | 0.002 | 0.002 | 0.002 |
| | | Sulfur content | mass % | 0.02 | 0.02 | 0.02 | 0.02 | 0.02 | 0.02 | 0.02 | 0.02 | 0.02 | 0.02 | 0.02 | 0.02 |
| Properties of the composition | | Kinematic viscosity at 100° C. | $mm^2/s$ | 5.30 | 5.20 | 5.30 | 5.30 | 5.30 | 5.30 | 5.30 | 5.30 | 5.30 | 5.30 | 5.30 | 5.30 |
| | | Total sulfur content | mass % | 0.13 | 0.18 | 0.24 | 0.13 | 0.15 | 0.12 | 0.16 | 0.12 | 0.17 | 0.07 | 0.34 | 0.07 |
| | | Phosphorus/Sulfur | | 0.24 | 0.16 | 0.12 | 0.24 | 0.21 | 0.25 | 0.19 | 0.25 | 0.17 | 0.43 | 0.09 | 0.42 |
| Fatigue life | | L50 | min | 370 | 380 | 351 | 340 | 420 | 362 | 409 | 367 | 355 | 325 | 312 | 286 |

1) to 17) in Table 1 are Referred to as the Following;

1) Hydrocracking base oil (kinematic viscosity at 100° C.: 2.6 $mm^2/s$, % $C_N$: 20, sulfur content: <0.001 mass %, viscosity index: 105)
2) Hydrocracking base oil (kinematic viscosity at 100° C.: 4.2 $mm^2/s$, % $C_N$: 22, sulfur content: <0.001 mass %, viscosity index: 125)
3) Naphthene-based base oil (kinematic viscosity at 100° C.: 3.7 $mm^2/s$, % $C_N$: 46, sulfur content: 0.06 mass %, viscosity index: 51)
4) Poly-α-olefin-based base oil (kinematic viscosity at 100° C.: 6.0 $mm^2/s$, sulfur content: 0.000 mass %, viscosity index: 133)
5) Solvent-refined base oil (kinematic viscosity at 100° C.: 10.84 $mm^2/s$, % $C_N$: 25, sulfur content: 0.6 mass %, viscosity index: 97)
6) Solvent-refined base oil (kinematic viscosity at 100° C.: 31.4 $mm^2/s$, % $C_N$: 23, sulfur content: 0.5 mass %, viscosity index: 97)
7) Di-2-ethylhexylphosphite (phosphorus content: 10.1 mass %)
8) Trilauryltrithiophosphite (phosphorus content: 4.9 mass %, sulfur content: 15.7 mass %)
9) Olefin sulfide (sulfur content: 46 mass %)
10) Thiadiazole (sulfur content: 36 mass %)
11) Polymethacrylate (weight-average molecular weight: 50,000)
12) Polybutenylsuccinimide (bis type)
13) Boric acid-modified polybutenylsuccinimide (bis type)
14) Calcium sulfonate (base number: 300 mgKOH/g)
15) Amine-based
16) Dialkyldiphenylamine
17) Polydimethylsiloxane

TABLE 2

| | | | | Examples | | | | |
|---|---|---|---|---|---|---|---|---|
| | | | | 10 | 11 | 12 | 13 | 14 |
| Composition - mass(%) | Base oil (A) based on the total amount of the base oil | Hydro-refined mineral oil A 1) | mass % | 52 | | 52 | 62 | 68 |
| | | Hydro-refined mineral oil B 2) | mass % | 35 | 35 | | | |
| | | Hydro-refined mineral oil C 3) | mass % | | | | 13 | 17 |
| | | Synthetic base oil A 4) | mass % | | | | | |
| | | Synthetic base oil B 5) | mass % | | | | | |
| | | Kinematic viscosity at 100° C. | $mm^2/s$ | 3.1 | 4.2 | 3.1 | 3.0 | 3.0 |
| | | % $C_N$ | | 20.8 | 22.0 | 20.8 | 20.3 | 20.4 |
| | | % $C_A$ | | 0 | 0 | 0 | 0 | 0 |
| | | Sulfur content | mass % | <0.001 | <0.001 | <0.001 | <0.001 | <0.001 |
| | Base oil (B) based on the total amount of the base oil | Solvent-refined mineral oil A 6) | mass % | 10 | 10 | 10 | | |
| | | Solvent-refined mineral oil B 7) | mass % | | | | 10 | 10 |
| | Synthetic oil (C) based on the total amount of the base oil | High molecular weight synthetic oil A 8) | mass % | | | | 10 | |
| | | High molecular weight synthetic oil B 9) | mass % | | | | | |
| | | High molecular weight synthetic oil C 10) | mass % | | | | | 5 |
| | | High molecular weight synthetic oil D 11) | mass % | 3 | 3 | 2 | | |
| | | High molecular weight synthetic oil E 12) | mass % | | | | | |
| | Properties of the base oil | Kinematic viscosity at 100° C. | $mm^2/s$ | 4.5 | 5.2 | 4.1 | 4.5 | 4.5 |
| | | % $C_N$ | | 20.8 | 21.8 | 20.7 | 18.3 | 19.8 |
| | | Sulfur content | mass % | 0.06 | 0.06 | 0.06 | 0.09 | 0.09 |
| | Extreme pressure additive (D) based on the total amount of the composition | Phosphorus-based extreme pressure additive 13) | mass % | 0.3 | 0.3 | 0.3 | 0.3 | 0.3 |
| | | Sulfur-based extreme pressure additive A 14) | mass % | 0.1 | 0.1 | 0.1 | | |
| | | Sulfur-based extreme pressure additive B 15) | mass % | | | | 0.15 | 0.15 |
| | | Phosphorus content | mass % | 0.03 | 0.03 | 0.03 | 0.03 | 0.03 |
| | | Sulfur content | mass % | 0.05 | 0.05 | 0.05 | 0.05 | 0.05 |
| | Other additives based on the total amount of the composition | Viscosity index improver 16) | mass % | | | 1.5 | | |
| | | Pour-point depressant 17) | mass % | 0.5 | 0.8 | | 0.5 | 0.5 |
| | | Ashless dispersant A 18) | mass % | 3 | 3 | 3 | 3 | 3 |
| | | Ashless dispersant B 19) | mass % | 1 | 1 | 1 | 1 | 1 |
| | | Metallic detergent 20) | mass % | 0.4 | 0.4 | 0.4 | 0.4 | 0.4 |
| | | Friction modifier A 21) | mass % | 0.1 | 0.1 | 0.1 | 0.1 | 0.1 |
| | | Friction modifier B 22) | mass % | | | | | |
| | | Friction modifier C 23) | mass % | | | | | |
| | | Friction modifier D 24) | mass % | | | | | |
| | | Anti-oxidant A 25) | mass % | 0.5 | 0.5 | 0.5 | 0.5 | 0.5 |
| | | Anti-oxidant B 26) | mass % | | | | 0.5 | 0.5 |
| | | Antifoamer 27) | mass % | 0.002 | 0.002 | 0.002 | 0.003 | 0.003 |
| | | Sulfur content | mass % | 0.02 | 0.02 | 0.02 | 0.02 | 0.02 |

TABLE 2-continued

| | | | | | | | |
|---|---|---|---|---|---|---|---|
| Properties of the composition | Kinematic viscosity at 100° C. | $mm^2/s$ | 5.50 | 6.10 | 5.50 | 5.50 | 5.50 |
| | Total sulfur content | mass % | 0.13 | 0.13 | 0.13 | 0.16 | 0.16 |
| | Phosphorus/Sulfur | | 0.23 | 0.23 | 0.23 | 0.19 | 0.19 |
| Low temperature viscosity (BF method) (−40° C.) | | mPa · s | 16,500 | 18,500 | 16,500 | 13,500 | 14,500 |
| ISOT (Increase of acid number) 165.5° C., 72 h | | mgKOH/g | 1.05 | 1.01 | 1.05 | 1.01 | 0.98 |
| Fatigue life L 50 | | min | 395 | 424 | 385 | 420 | 425 |

| | | | | Examples | | | Comparative Examples |
|---|---|---|---|---|---|---|---|
| | | | | 15 | 16 | 17 | 4 |
| Composition - mass(%) | Base oil (A) based on the total amount of the base oil | Hydro-refined mineral oil A 1) | mass % | 70 | 70 | 70 | 33 |
| | | Hydro-refined mineral oil B 2) | mass % | | | | 64 |
| | | Hydro-refined mineral oil C 3) | mass % | 17 | 17 | 17 | |
| | | Synthetic base oil A 4) | mass % | | | | |
| | | Synthetic base oil B 5) | mass % | | | | |
| | | Kinematic viscosity at 100° C. | $mm^2/s$ | 3.0 | 3.0 | 3.0 | 3.5 |
| | | % $C_N$ | | 20.4 | 20.4 | 20.4 | 21.3 |
| | | % $C_A$ | | 0 | 0 | 0 | 0 |
| | | Sulfur content | mass % | <0.001 | <0.001 | <0.001 | <0.001 |
| | Base oil (B) based on the total amount of the base oil | Solvent-refined mineral oil A 6) | mass % | | | | |
| | | Solvent-refined mineral oil B 7) | mass % | 10 | 10 | 10 | |
| | Synthetic oil (C) based on the total amount of the base oil | High molecular weight synthetic oil A 8) | mass % | | | | |
| | | High molecular weight synthetic oil B 9) | mass % | | | | |
| | | High molecular weight synthetic oil C 10) | mass % | | | | |
| | | High molecular weight synthetic oil D 11) | mass % | 3 | 3 | 3 | 3 |
| | | High molecular weight synthetic oil E 12) | mass % | | | | |
| | Properties of the base oil | Kinematic viscosity at 100° C. | $mm^2/s$ | 4.5 | 4.5 | 4.5 | 4.5 |
| | | % $C_N$ | | 20.1 | 20.1 | 20.1 | 20.9 |
| | | Sulfur content | mass % | 0.09 | 0.09 | 0.09 | 0.00 |
| | Extreme pressure additive (D) based on the total amount of the composition | Phosphorus-based extreme pressure additive 13) | mass % | 0.3 | 0.3 | 0.3 | 0.3 |
| | | Sulfur-based extreme pressure additive A 14) | mass % | | | | 0.1 |
| | | Sulfur-based extreme pressure additive B 15) | mass % | 0.15 | 0.15 | 0.15 | |
| | | Phosphorus content | mass % | 0.03 | 0.03 | 0.03 | 0.03 |
| | | Sulfur content | mass % | 0.05 | 0.05 | 0.05 | 0.05 |
| | Other additives based on the total amount of the composition | Viscosity index improver 16) | mass % | | | | |
| | | Pour-point depressant 17) | mass % | 0.5 | 0.5 | 0.5 | 0.5 |
| | | Ashless dispersant A 18) | mass % | 3 | 3 | 5 | 3 |
| | | Ashless dispersant B 19) | mass % | 1 | 5 | 3 | 1 |
| | | Metallic detergent 20) | mass % | 0.4 | 0.4 | 0.4 | 0.4 |
| | | Friction modifier A 21) | mass % | 0.1 | | 0.1 | 0.1 |
| | | Friction modifier B 22) | mass % | | 0.1 | | |
| | | Friction modifier C 23) | mass % | | | 0.1 | |
| | | Friction modifier D 24) | mass % | | 0.1 | | |
| | | Anti-oxidant A 25) | mass % | 0.5 | 0.5 | 0.5 | 0.5 |
| | | Anti-oxidant B 26) | mass % | 0.5 | 0.5 | 0.5 | |
| | | Antifoamer 27) | mass % | 0.003 | 0.003 | 0.003 | 0.002 |
| | | Sulfur content | mass % | 0.02 | 0.02 | 0.02 | 0.02 |
| Properties of the composition | | Kinematic viscosity at 100° C. | $mm^2/s$ | 5.50 | 5.50 | 5.50 | 5.50 |
| | | Total sulfur content | mass % | 0.16 | 0.16 | 0.16 | 0.07 |
| | | Phosphorus/Sulfur | | 0.19 | 0.19 | 0.19 | 0.43 |
| Low temperature viscosity (BF method) (−40° C.) | | | mPa · s | 16,500 | 17,000 | 16,800 | 16,500 |
| ISOT (Increase of acid number) 165.5° C., 72 h | | | mgKOH/g | 0.99 | 0.96 | 1.00 | 1.01 |
| Fatigue life L 50 | | | min | 435 | 440 | 420 | 321 |

| | | | | Comparative Examples | | | Reference |
|---|---|---|---|---|---|---|---|
| | | | | 5 | 6 | 7 | Example 1 |
| Composition - mass(%) | Base oil (A) based on the total amount of the base oil | Hydro-refined mineral oil A 1) | mass% | 60 | 71.5 | | 50 |
| | | Hydro-refined mineral oil B 2) | mass% | | | | 40 |
| | | Hydro-refined mineral oil C 3) | mass% | 12 | 18 | | |
| | | Synthetic base oil A 4) | mass% | | | 45 | |
| | | Synthetic base oil B 5) | mass% | | | 55 | |
| | | Kinematic viscosity at 100°C. | $mm^2/s$ | 2.9 | 3.0 | 3.0 | 3.2 |
| | | % $C_N$ | | 20.3 | 20.4 | 9.5 | 20.9 |
| | | % $C_A$ | | 0 | 0 | 0 | 0 |
| | | Sulfur content | mass% | <0.001 | <0.001 | <0.001 | <0.001 |
| | Base oil (B) based on the total amount of the base oil | Solvent-refined mineral oil A 6) | mass% | | | | 10 |
| | | Solvent-refined mineral oil B 7) | mass% | 10 | 10 | 10 | |
| | Synthetic oil (C) based on the total amount of the | HighmolecularweightsyntheticoilA8) | mass% | | | | |
| | | HighmolecularweightsyntheticoilB9) | mass% | 18 | | | |
| | | HighmolecularweightsyntheticoilC10) | mass% | | | | |

TABLE 2-continued

| | | | | | | | | |
|---|---|---|---|---|---|---|---|---|
| base oil | High molecular weight synthetic oil D 11) | mass% | | | 3 | |
| | High molecular weight synthetic oil E 12) | mass% | | 0.5 | | |
| Properties of the base oil | Kinematic viscosity at 100°C. | $mm^2/s$ | 4.5 | 4.5 | 4.5 | 3.5 |
| | % $C_N$ | | 17.9 | 20.5 | 11.9 | 21.3 |
| | Sulfur content | mass% | 0.09 | 0.09 | 0.09 | 0.06 |
| Extreme pressure additive (D) based on the total amount of the composition | Phosphorus-based extreme pressure additive 13) | mass% | 0.3 | 0.3 | 0.3 | 0.3 |
| | Sulfur-based extreme pressure additive A 14) | mass% | | | | 0.1 |
| | Sulfur-based extreme pressure additive B 15) | mass% | 0.15 | 0.15 | 0.15 | |
| | Phosphorus content | mass% | 0.03 | 0.03 | 0.03 | 0.03 |
| | Sulfur content | mass% | 0.05 | 0.05 | 0.05 | 0.05 |
| Other additives based on the total amount of the composition | Viscosity index improver 16) | mass% | | | | 4 |
| | Pour-point depressant 17) | mass% | 0.5 | 0.5 | 0.5 | |
| | Ashless dispersant A 18) | mass% | 3 | 3 | 3 | 3 |
| | Ashless dispersant B 19) | mass% | 1 | 1 | 1 | 1 |
| | Metallic detergent 20) | mass% | 0.4 | 0.4 | 0.4 | 0.4 |
| | Friction modifier A 21) | mass% | 0.1 | 0.1 | 0.1 | 0.1 |
| | Friction modifier B 22) | mass% | | | | |
| | Friction modifier C 23) | mass% | | | | |
| | Friction modifier D 24) | mass% | | | | |
| | Anti-oxidant A 25) | mass% | 0.5 | 0.5 | 0.5 | 0.5 |
| | Anti-oxidant B 26) | mass% | | | 0.5 | |
| | Antifoamer 27) | mass% | 0.003 | 0.003 | 0.003 | 0.002 |
| | Sulfur content | mass% | 0.02 | 0.02 | 0.02 | 0.02 |
| Properties of the composition | Kinematic viscosity at 100° C. | $mm^2/s$ | 5.50 | 5.50 | 5.50 | 5.30 |
| | Total sulfur content | mass % | 0.16 | 0.16 | 0.16 | 0.13 |
| | Phosphorus/Sulfur | | 0.19 | 0.19 | 0.19 | 0.23 |
| Low temperature viscosity (BF method) (−40° C.) | | mPa · s | 12,500 | 25,000 | 6,400 | 15,900 |
| ISOT (Increase of acid number) 165.5° C., 72 h | | mgKOH/g | 1.00 | 1.02 | 0.81 | 1.06 |
| Fatigue life L 50 | | min | 325 | 425 | 340 | 370 |

※ 1) to 27) in Table 2 are Referred to as the Following;

1) Hydrocracking base oil (kinematic viscosity at 100° C., 2.6 $mm^2/s$, % $C_N$: 20, sulfur content: <0.001 mass %, viscosity index: 105)
2) Hydrocracking base oil (kinematic viscosity at 100° C.: 4.2 $mm^2/s$, % $C_N$: 22, sulfur content: <0.001 mass %, viscosity index: 125)
3) Hydrocracking base oil (kinematic viscosity at 100° C.: 6.2 $mm^2/s$, % $C_N$: 22, sulfur content: 0.001 mass %, viscosity index: 132)
4) Poly-α-olefin-based base oil (kinematic viscosity at 100° C.: 6.0 $mm^2/s$, sulfur content: 0.000 mass %, viscosity index: 133)
5) Poly-α-olefin-based base oil (kinematic viscosity at 100° C.: 1.9 $mm^2/s$, sulfur content: 0.000 mass %, viscosity index: 100)
6) Solvent-refined base oil (kinematic viscosity at 100° C., 10.84 $mm^2/s$, % $C_N$: 25, sulfur content: 0.6 mass %, viscosity index: 97)
7) Solvent-refined base oil (kinematic viscosity at 100° C.: 21.9 $mm^2/s$, % $C_N$: 22, sulfur content: 0.91 mass %, viscosity index: 95)
8) Poly-α-olefin-based base oil (kinematic viscosity at 100° C.: 100 $mm^2/s$, sulfur content: 0.000 mass %, viscosity index: 156, number-average molecular weight: 4,000)
9) Ethylene-α-olefin copolymer base oil (kinematic viscosity at 100° C.: 100 $mm^2/s$, number-average molecular weight: 1,500)
10) Ethylene-α-olefin copolymer base oil (kinematic viscosity at 100° C.: 600 $mm^2/s$, number-average molecular weight: 2,500)
11) Ethylene-α-olefin copolymer base oil (kinematic viscosity at 100° C.: not measured, number-average molecular weight: 18,000)
12) Ethylene-α-olefin copolymer base oil (kinematic viscosity at 100° C.: not measured, number-average molecular weight: 25,000)
13) Di-2-ethylhexylphosphite (phosphorus content: 10.1 mass %)
14) Olefin sulfide (sulfur content: 46 mass %)
15) Thiadiazole (sulfur content: 36 mass %)
16) Polymethacrylate (weight-average molecular weight: 50,000)
17) Polymethacrylate (weight-average molecular weight: 100,000)
18) Polybutenylsuccinimide (bis type)
19) Boric acid-modified polybutenylsuccinimide (bis type)
20) Calcium sulfonate (base number: 300 mgKOH/g)
21) Amine-based
22) Fatty acid-based
23) Ester-based
24) Amide-based
25) Dialkyldiphenylamine
26) Hindered phenol
27) Polydimethylsiloxane As apparent from the results shown in Table 1, the lubricating oil compositions (Examples 1 to 9) exhibited excellent fatigue life properties.

Particularly, in the case where the % $C_N$ of Component (A) was adjusted to 17 to 30, a phosphorus-based extreme pressure additive and a sulfur-based extreme pressure additive were used in combination as Component (D) and the P/S ratio in the composition was adjusted to 0.15 to 0.25 (Examples 1, 2 and 5 to 8), the compositions thereof had more excellent fatigue life properties than those (Example 3 wherein the P/S ratio was less than 0.15, Example 4 wherein the % $C_N$ of Component (A) was less than 17 and Example 9 wherein the phosphorus-sulfur-based extreme pressure additive was used). In the case where the P/S ratio in the composition was from 0.19 to 0.23 or the % $C_N$ of Component (A) is 23 or greater (Examples 5 and 7), the composition thereof had particularly excellent fatigue life properties.

It was apparent that the composition containing no Component (B) (Comparative Example 1), that whose total sulfur content is more than 0.3 percent by mass (Comparative Example 2) and that whose Component (D) was only a sulfur-free extreme pressure additive and P/S ratio was greater than 0.40 (Comparative Example 3) were all poor in fatigue life properties.

As apparent from the results shown in Table 2, the lubricating oil compositions for transmission of the present invention (Examples 10 to 17) exhibited excellent fatigue life properties, low temperature viscosity and oxidation stability.

Particularly in the case where solvent refined mineral oil B whose kinematic viscosity at 100° C. was 21.9 $mm^2/s$ and sulfur content was 0.91 percent by mass was added to the compositions whose kinematic viscosity at 100° C. was adjusted to 5 to 6.5 $mm^2/s$, as Component (B) (Examples 13 to 17), the resulting compositions were more improved in fatigue life properties than the compositions containing solvent refined mineral oil A whose kinematic viscosity at 100° C. was 10.84 $mm^2/s$ and sulfur content was 0.6 percent by mass (Examples 10 and 12) and exhibited fatigue life properties equivalent to or greater than the composition whose kinematic viscosity at 100° C. was greater than 6 $mm^2/s$ (Example 11) The ethylene-α-olefin copolymer among Components (C) was excellent in the effect of improving fatigue life properties, and the greater its molecular weight, the more the fatigue life properties were improved (Examples 14 and 15). Furthermore, the compositions containing the amine-based friction modifier, fatty acid-based friction modifier or amide-based friction modifier (Examples 15 and 16) were capable of improving fatigue life properties better than that containing the ester-based friction modifier (Example 17). The compositions containing the phenol-based antioxidant and amine-based antioxidant in combination (Examples 13 to 17) were capable of improving oxidation stability better.

The composition containing no Component (C) but the polymethacrylate having a weight average molecular weight of 50,000 (Reference Example 1) was improved in fatigue life properties only by addition of Component (B) but failed to obtain the advantageous effects as achieved by the present invention. The composition containing no Component (B) (Comparative Example 4), that containing more than 15 percent by mass of Component (C) whose number average molecular weight was less than 2,000 (Comparative Example 5) and that containing the poly-α-olefin-based base oil instead of Component (A) (Comparative Example 7) were poor in the effect of improving fatigue life properties. Furthermore, Component (C) whose molecular weight is greater than 20,000 is not preferable because the Brookfield viscosity at −40° C. exceeds 20,000 mPa·s even though Component (C) was blended in an amount of only 0.5 percent by mass (Comparative Example 6).

APPLICABILITY IN THE INDUSTRY

The lubricating oil composition for transmissions of the present invention with the above-described component structure can decrease the stirring resistance of gears, transmission clutches, torque converters and oil pumps. Therefore, the composition can render transmissions or final reduction gear units to contribute an improvement in fuel efficiency and is also excellent in fatigue life properties for bearings or gears, low temperature viscosity and oxidation stability and extremely effective as a novel fuel economy type transmission lubricating oil composition.

The invention claimed is:

1. A lubricating oil composition for transmissions which comprises a lubricating base oil consisting essentially of (A) from 60 to 95 percent by mass, based on the total amount of the base oil, of a hydrocracked mineral oil and/or a wax-isomerized isoparaffin base oil so adjusted to have a kinematic viscosity at 100° C. of from 1.5 to 4 $mm^2/s$, a viscosity index of 110 or more, and a % $C_N$ of from 10 to 26.2 and (B) from 5 to 40 percent by mass, based on the total amount of the base oil, of a mineral lubricating base oil having a kinematic viscosity at 100° C. of from 16 to 50 $mm^2/s$, a % $C_N$ of from 15 to 40, and a sulfur content of from 0.3 to 1 percent by mass, and (D) from 0.05 to 2 percent by mass, based on the total amount of the composition, of an extreme pressure additive consisting essentially of a phosphorus-based extreme pressure additive selected from the group consisting of phosphoric acid, phosphorous acid, and phosphorous acid esters and a sulfur-based extreme pressure additive selected from the group consisting of sulfurized fats and oils, dihydrocarbyl polysulfides represented by formula (2) below, thiadiazoles, and benzothiazoles, $$R^{13}\text{-}Sy\text{-}R^{14} \quad (2)$$

wherein $R^{13}$ and $R^{14}$ are each independently a saturated alkyl group or a cycloalkyl group having 1 to 20 carbon atoms, and y is an integer of 2 to 8;

wherein in the composition, the phosphorus content (P) is from 0.01 to 0.05 percent by mass, the total sulfur content (S) is from 0.05 to 0.3 percent by mass, and the P/S ratio of the phosphorus content contained in Component (D) to the total sulfur content in the composition is from 0.21 to 0.40, the composition has a kinematic viscosity at 100° C. of 3 to 6.5 $mm^2/s$, and wherein the composition further comprises at least one bis type non-borated succinimides and at least one bis type borated succinimides having in their molecules at least one alkyl or alkenyl group having 40 to 400 carbon atoms and derivatives thereof as ashless dispersants.

2. A lubricating oil composition for transmissions which comprises a lubricating base oil consisting essentially of (A) from 60 to 94 percent by mass, based on the total amount of the base oil, of a hydrocracked mineral oil and/or a wax-isomerized isoparaffin base oil so adjusted to have a kinematic viscosity at 100° C. of from 1.5 to 4 $mm^2/s$, a viscosity index of 110 or more, a % $C_N$ of from 10 to 26.2 and a % $C_A$ of 1 or less, (B) from 5 to 25 percent by mass, based on the total amount of the base oil, of a mineral lubricating base oil having a kinematic viscosity at 100° C. of from 16 to 50 $mm^2/s$, a % $C_N$ of from 15 to 40, and a sulfur content of from 0.3 to 1 percent by mass and (C) from 1 to 15 percent by mass, based on the total amount of the base oil, of a synthetic oil composed of polymers or copolymers of α-olefins having 2 to 32 carbon atoms and having a number average molecular weight of from 4,000 to 20,000, and (D) from 0.05 to 2 percent by mass, based on the total amount of the composition, of an extreme pressure additive consisting essentially of a phosphorus-based extreme pressure additive selected from the group consisting of phosphoric acid, phosphorous acid, and phosphorous acid esters and a sulfur-based extreme pressure additive selected from the group consisting of sulfurized fats and oils, dihydrocarbyl polysulfides represented by formula (2) below, thiadiazoles, and benzothiazoles, $$R^{13}\text{-}Sy\text{-}R^{14} \quad (2)$$

wherein $R^{13}$ and $R^{14}$ are each independently a saturated alkyl group or a cycloalkyl group having 1 to 20 carbon atoms, and y is an integer of 2 to 8;

wherein in the composition, the phosphorus content (P) is from 0.01 to 0.05 percent by mass, the total sulfur content (S) is from 0.05 to 0.3 percent by mass, and the P/S ratio of the phosphorus content contained in Component (D) to the total sulfur content in the composition is from 0.21 to 0.40; the composition has a kinematic viscosity at 100° C. of from 3 to 6.5 $mm^2/s$, and wherein the composition further comprises at least one bis type non-borated succinimides and at least one bis type borated succinimides each having in their molecules at least one alkyl or alkenyl group having 40 to 400 carbon atoms and derivatives thereof as ashless dispersants.

3. The lubricating oil composition for transmissions according to claim 1 wherein the lubricating base oil comprising Components (A) and (B) has a kinematic viscosity at 100° C. of from 2.5 to 4.5 $mm^2/s$.

4. The lubricating oil composition for transmissions according to claim 2 wherein the lubricating base oil comprising Components (A), (B) and (C) has a kinematic viscosity at 100° C. of from 4.0 to 5.5 $mm^2/s$.

5. The lubricating oil composition for transmissions according to claim 1 wherein the phosphorus-supplying source is phosphorus acid esters.

6. The lubricating oil composition for transmissions according to claim 1 wherein the composition contains at least one type of additive selected from the group consisting of viscosity index improvers, pour point depressants, alkaline earth metal-based detergents, antioxidants and friction modifiers.

7. The lubricating oil composition for transmissions according to claim 1 wherein the composition is used for automatic transmissions.

8. The lubricating oil composition for transmissions according to claim 1 wherein the composition is used for manual transmissions.

9. The lubricating oil composition for transmissions according to claim 1 wherein the composition is used for continuously variable transmissions.

10. A method of improving the fatigue life properties of a lubricating oil composition for transmissions which comprises utilizing in a transmission a lubricating base oil consisting essentially of (A) from 60 to 95 percent by mass, based on the total amount of the base oil, of a hydrocracked mineral oil and/or a wax-isomerized isoparaffin base oil so adjusted to have a kinematic viscosity at 100° C. of from 1.5 to 4 $mm^2/s$, a viscosity index of 110 or more, and a % $C_N$ of from 10 to 26.2 and (B) from 5 to 40 percent by mass, based on the total amount of the base oil, of a mineral lubricating base oil having a kinematic viscosity at 100° C. of from 16 to 50 $mm^2/s$, a % $C_N$ of from 15 to 40, and a sulfur content of from 0.3 to 1 percent by mass, and (D) from 0.05 to 2 percent by mass, based on the total amount of the composition, of an extreme pressure additive consisting essentially of a phosphorus-based extreme pressure additive selected from the group consisting of phosphoric acid, phosphorous acid, and phosphorous acid esters and a sulfur-based extreme pressure additive selected from the group consisting of sulfurized fats and oils, dihydrocarbyl polysulfides represented by formula (2) below, thiadiazoles, and benzothiazoles, $$R^{13}\text{-Sy-}R^{14} \quad (2)$$

wherein $R^{13}$ and $R^{14}$ are each independently a saturated alkyl group or a cycloalkyl group having 1 to 20 carbon atoms, and y is an integer of 2 to 8;

wherein in the composition, the phosphorus content (P) is from 0.01 to 0.05 percent by mass, the total sulfur content (S) is from 0.05 to 0.3 percent by mass, and the P/S ratio of the phosphorus content contained in Component (D) to the total sulfur content in the composition is from 0.21 to 0.40; the composition has a kinematic viscosity at 100° C. of from 3 to 6.5 $mm^2/s$, and wherein the composition further comprises at least one bis type non-borated succinimides and at least one bis type borated succinimides each having in their molecules at least one alkyl or alkenyl group having 40 to 400 carbon atoms and derivatives thereof as ashless dispersants.

11. A method of improving the fatigue life properties of a lubricating oil composition for transmissions which comprises utilizing in a transmission a lubricating base oil consisting essentially of (A) from 60 to 94 percent by mass, based on the total amount of the base oil, of a hydrocracked mineral oil and/or a wax-isomerized isoparaffin base oil so adjusted to have a kinematic viscosity at 100° C. of from 1.5 to 4 $mm^2/s$, a viscosity index of 110 or more, a % $C_N$ of from 10 to 26.2 and a % $C_A$ of 1 or less, (B) from 5 to 25 percent by mass, based on the total amount of the base oil, of a mineral lubricating base oil having a kinematic viscosity at 100° C. of from 16 to 50 $mm^2/s$, a % $C_N$ of from 15 to 40, and a sulfur content of from 0.3 to 1 percent by mass and (C) from 1 to 15 percent by mass, based on the total amount of the base oil, of a synthetic oil composed of polymers or copolymers of α-olefins having 2 to 32 carbon atoms and having a number average molecular weight of from 4,000 to 20,000, and (D) from 0.05 to 2 percent by mass, based on the total amount of the composition, of an extreme pressure additive consisting essentially of a phosphorus-based extreme pressure additive selected from the group consisting of phosphoric acid, phosphorous acid, and phosphorous acid esters and a sulfur-based extreme pressure additive selected from the group consisting of sulfurized fats and oils, dihydrocarbyl polysulfides represented by formula (2) below, thiadiazoles, and benzothiazoles, $$R^{13}\text{-Sy-}R^{14} \quad (2)$$

wherein $R^{13}$ and $R^{14}$ are each independently a saturated alkyl group or a cycloalkyl group having 1 to 20 carbon atoms, and y is an integer of 2 to 8;

wherein in the composition, the phosphorus content (P) is from 0.01 to 0.05 percent by mass, the total sulfur content (S) is from 0.05 to 0.3 percent by mass, and the P/S ratio of the phosphorus content contained in Component (D) to the total sulfur content in the composition is from 0.21 to 0.40; the composition has a kinematic viscosity at 100° C. of 3 to 6.5 $mm^2/s$, and wherein the composition further comprises bis at least one bis type non-borated succinimides and at least one bis type borated succinimides each having in their molecules at least one alkyl or alkenyl group having 40 to 400 carbon atoms and derivatives thereof as ashless dispersants.

12. The lubricating oil composition for transmissions according to claim 1, wherein the lubricating base oil of Component (A) has a kinematic viscosity at 100° C. of from 2.0 to 3.8 $mm^2/s$.

13. The lubricating oil composition for transmissions according to claim 2, wherein the lubricating base oil of Component (A) has a kinematic viscosity at 100° C. of from 2.0 to 3.8 $mm^2/s$.

14. The lubricating oil composition for transmissions according to claim 1, wherein the lubricating base oil of Component (A) has a % $C_N$ of from 17 to 26.2.

15. The lubricating oil composition for transmissions according to claim 2, wherein the lubricating base oil of Component (A) has a % $C_N$ of from 17 to 26.2.

16. The method of improving the fatigue life properties of a lubricating oil composition for transmissions according to claim 10, wherein the lubricating base oil of Component (A) has a % $C_N$ of from 17 to 26.2.

17. The method of improving the fatigue life properties of a lubricating oil composition for transmissions according to claim 11, wherein the lubricating base oil of Component (A) has a % $C_N$ of from 17 to 26.2.

18. The lubricating oil composition for transmissions according to claim 1, wherein the composition comprises 75 to 95 percent by mass of Component (A) and 5 to 25 percent by mass of Component (B).

19. The method of improving the fatigue life properties of a lubricating oil composition for transmissions according to claim 10, wherein the composition comprises 75 to 95 percent by mass of Component (A) and 5 to 25 percent by mass of Component (B).

* * * * *